United States Patent [19]

Carrens

[11] 4,293,287

[45] Oct. 6, 1981

[54] REVERSING VALVE ASSEMBLY FOR A FLUID OPERATED WELL PUMP

[75] Inventor: Donald E. Carrens, Tulsa, Okla.

[73] Assignee: Dresser Industries, Inc., Dallas, Tex.

[21] Appl. No.: 22,590

[22] Filed: Mar. 21, 1979

[51] Int. Cl.[3] ..... F04B 47/08; F01L 25/06

[52] U.S. Cl. ..... 417/393; 91/329; 91/319

[58] Field of Search ..... 91/319, 329; 417/393

[56] References Cited

U.S. PATENT DOCUMENTS

| | | | |
|---|---|---|---|
| 2,081,220 | 5/1937 | Coberly | 417/404 |
| 2,311,157 | 2/1943 | Coberly | 91/319 X |
| 2,935,953 | 5/1960 | Coberly | 91/319 X |
| 2,949,857 | 8/1960 | Coberly | 417/393 X |
| 3,082,749 | 3/1963 | Coberly | 91/319 X |
| 3,849,030 | 11/1974 | McArthur et al. | 417/393 |
| 3,922,116 | 11/1975 | Pugh | 417/393 |

*Primary Examiner*—Leonard E. Smith

*Attorney, Agent, or Firm*—J. N. Hazelwood; W. R. Peoples

[57] ABSTRACT

A reversing control valve for a fluid operated downhole oil well pump having reciprocating pistons that is constructed to control the velocity and reversing of the pistons. The control valve functions to control the piston velocity and prevent damage to the pump components due to shock stresses induced by pressure impulses typically associated with pumped well fluids. The reversing control valve is constructed to regulate the piston velocity in response to the sensing of several pressure conditions in the well and in the pump.

26 Claims, 24 Drawing Figures

REVERSING VALVE ASSEMBLY FOR A FLUID OPERATED WELL PUMP

TECHNICAL FIELD

This invention is related to downhole hydraulically powered oil well pumps and specifically it is related to the piston reversing control valve assembly for such pumps.

BACKGROUND OF THE INVENTION

In the prior art, piston reversing control valves for this style of downhole hydraulically powered pump are simple in nature in that they function to reverse the piston assembly when it reaches the end of a stroke without regard to the well fluid pressure and the presence of a two-phased, gas and liquid, medium within the pumped zone of the well. The primary disadvantage of the prior art reversing control valves is their inability to compensate for a two-phased medium cavitation or a dry hole condition in the well and the well pressures. The result of this inability in the prior art is damage to the pump which is caused by the pump being operated without the proper fluids and pressures being present which causes the piston to greatly accelerate during the stroke and then contact a liquid at some position of the stroke thereby damaging components of the pump.

SUMMARY OF THE INVENTION

The pump reversing control valve comprises a valve mechanism that includes a generally tubular valve sleeve mounted in the bore of a hollow tubular pump valve housing around a piston rod, between upper and lower pump cylinders and a fluid powered control system to control positioning of the tubular valve sleeve. The tubular valve sleeve is provided with a plurality of recesses, ports and passageways which cooperate with appropriate passageways, the tubular valve housing and a pair of annular recesses around opposite end portions of the piston connecting pump rod. The pump has a plurality of passages which direct the power fluid from a power fluid inlet to the tubular valve housing and tubular valve sleeve and into and out of the respective pump cylinders in order to affect motion of the pistons.

One object of this invention is to provide a reversing control valve assembly for a fluid powered downhole well pump which will reverse the piston direction to achieve a pumping action and will accommodate pressure changes in the well fluids and operation in a two-phase, gas and liquid medium and in a cavitation mode without damaging the pump structure.

Still, one other object of this invention is to provide a reversing valve control assembly for a fluid operated downhole well pump which has a fluid powered system for positioning the reversing valve to limit the velocity of the pistons in order to prevent damage to the pistons and other parts of the pump due to the excessive dynamic forces introduced by uncontrolled piston motion.

Still, another object of this invention is to provice a structurally simple reversing control valve that is compatible with conventionally styled double acting piston type downhole oil well pumps.

Various other objects, advantages and features of this invention will become apparent to those skilled in the art from the following discussion, taken in conjunction with the accompanying drawings, in which:

DESCRIPTION OF THE DRAWINGS

FIGS. 1, 2, 9–13 and 15–17 are schematic sectional views and certain of the passageways are shown in one plane for convenience in explanation of the valving mechanism while they are actually spaced about the tubular valve sleeve as clearly shown in the transverse cross-sectional views and shown in FIGS. 18, 19 and 20.

Figure 1:
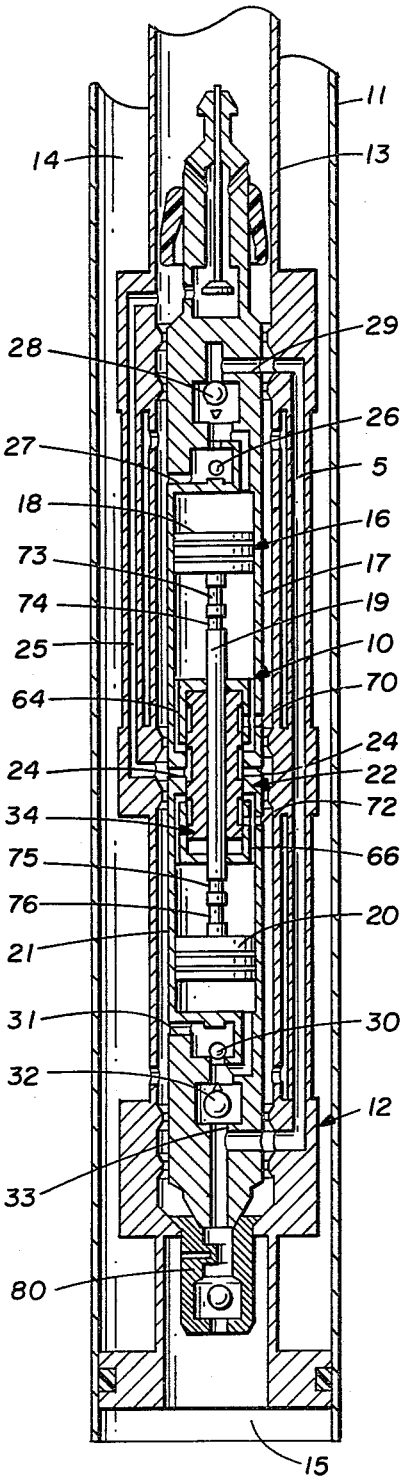
FIG. 1 is a schematic cutaway elevation view of a fluid operated pump in a well embodying this invention with the pump shown during the upward movement of the piston assembly.

Following is a discussion and description of preferred specific embodiments of the reversing control valve structure of this invention, such being made with reference to the drawings, whereupon the same reference numerals are used to indicate the same or similar parts and/or structure. It is to be understood that such discussion and description is not to unduly limit the scope of the invention.

DETAILED DESCRIPTION

Referring to the drawings and in particular, FIG. 1 wherein the fluid operated downhole well pump 10 is shown in a segment of well casing 11 and mounted within a bottom hole receptacle 12 and connected to a power fluid conduit 13. The bottom hole receptacle 12 divides well casing 11 into an annular fluid return passage 14 and a formation fluid zone 15. The formation fluid zone 15 is in fluid communication with the well fluids which are to be pumped from the well. Pump 10 is adapted to pump the well fluids from the formation zone 15 which is substantially at the formation fluid pressure and into and upwardly through annular fluid return passage 14.

Pump 10 is provided with a tubular valve housing or pump body mounted between an upper pump cylinder 17 and a lower pump cylinder 21. Upper pump cylinder 17 contains an upper pump piston 18. This upper pump piston is connected by a piston rod 19 to a lower pump piston 20 which is mounted within a lower pump cylinder 21. Pistons 18 and 20 and piston rod 19 form the piston assembly indicated generally at 16. Between the upper and the lower pump cylinders 17 and 21 is the reversing valve mechanism indicated generally at 22. Piston rod 19 is provided with annular recesses 73 and 74 around its upper end portion and other similar annular recesses 75 and 76 at its lower end portion. These piston rod recesses are arranged in a spaced relation to each other and a spaced relation to the associated piston for reasons which will become evident to those skilled in the art from the following.

A plurality of circumferentially spaced power fluid inlet passages 24 are formed through the tubular valve housing 61 or pump valve body at a mid-portion thereof. Power fluid is communicated from power fluid conduit 13 to a retriever valve at the top of the pump, then through a power fluid distribution passage 25 on the exterior of the bottom hole receptacle 12 to reversing valve mechanism 22 where it connects with inlet passages 24. A plurality of circumferentially spaced and radially oriented power fluid outlet passages 70 and 72 through the respective upper and lower portions of tubular valve housing 61 communicate spent power fluid to annular fluid return passage 14.

Also, pump 10 is provided with several other internal valve assemblies including a discharge valve 26 which is in fluid communication with the upper portion of upper pump cylinder 17 and annular fluid return passage 14 through a discharge passageway 27. An upper checkvalve 28 is in fluid communication with the upper portion of upper pump cylinder 17 and formation fluid zone 15 through an inlet passage 29. A lower discharge valve 30 and a lower checkvalve 32 are in fluid communication with the lower portion of lower pump cylinder 21. Discharge valve 30 communicates with annular fluid return passage 14 through a discharge passage 31. A checkvalve 32 is in fluid communication with the formation fluid zone 15 through an inlet passage 33. A tubing standing valve 80 in the bottom hole receptacle 12 admits well fluid into inlet passage 33. Well fluid from formation fluid zone 15 reaches the upper portion of pump 10 through a formation fluid distribution conduit 5 on the exterior of bottom hole receptacle 12. Well fluid passing through conduit 5 enters passageway 29 which connects to checkvalve 28. The several internal valve assemblies function to direct the fluid flow from the appropriate piston chambers into annular fluid return passage 14 and prevent the fluid in this passage from returning to the well once it has passed through the pump.

Referring to FIGS. 2 and 18–20, valving mechanism 22 includes a generally tubular valve sleeve 34, which is longitudinally movably mounted through the center portion of the valve mechanism. Tubular valve sleeve 34 is mounted around piston rod 19 within a bore in tubular valve housing 61 and provides the valving connection between the power fluid source and the pump cylinders. The interior of tubular valve sleeve 34 is defined by a bore 2 aligning with the longitudinal axis thereof. The middle exterior portion of tubular valve sleeve 34 has two large partially annular recesses 35 and 36 formed on each of two opposite side portions thereof. A plurality of smaller and shallower recesses 37 and 38 join these larger recesses and extend respectively upward and downward therefrom. Each large recess 35 and 36 is shown with four of the smaller and shallower recesses. The upper portion of tubular valve sleeve 34 has a large recess 39 formed in large segments on generally opposed sides of the valve sleeve which are connected by a peripherally connecting portion at the longitudinally outer portion of the recess segments. A plurality of smaller throttling recesses 40 are formed in the tubular valve sleeve in a spaced relation around the lower edge of the two (2) large segments of recess 39. Another large recess 41 similar to large recess 39 is formed around the opposite or lower end portion of tubular valve sleeve 34. Large recess 41 has a plurality of smaller throttling recesses 42 similar to throttling recesses 40. Functionally, all of the throttling recesses 37, 38, 40 and 42 provide a flow restrictive orifice opening and they may be varied in shape and number at the option of the designer without departing from the scope of this invention.

Figure 20:
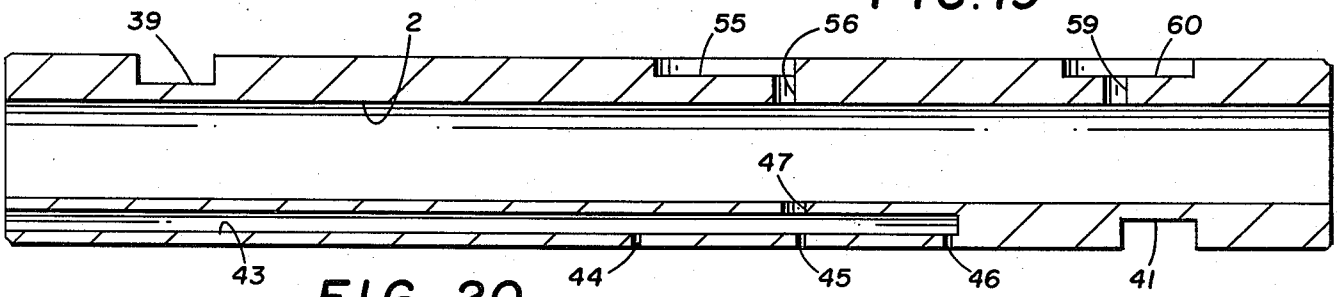
FIG. 20 is a cross-sectional elevation view of the tubular valve sleeve taken vertically through the tubular valve sleeve as shown in FIG. 19.

Tubular valve sleeve 34 is provided with an internal passage 43 formed generally parallel to the internal bore 2 and communicative from the upper end thereof to pressure sensing ports 44, 45, 46 and 47. Pressure sensing ports 44, 45 and 46 communicate to the tubular valve sleeve exterior and port 47 communicates to sleeve bore 2. The generally opposite side of tubular valve sleeve 34 is similarly provided with an internal passage 48 from the lower end thereof which is communicative with pressure sensing ports 49, 50, 51 and 52. Pressure sensing 49, 50 and 51 open to the exterior of tubular valve sleeve 34 along their associated connected internal passage 43 and port 52 opens to tubular valve sleeve bore 2. FIG. 20 clearly shows passage 43 and ports 44, 45, 46 and 47.

Further, tubular valve sleeve 34 is provided with a medium size recess 53 in the outer periphery of the member located generally between larger recesses 35 and 36 in the periphery of the valve sleeve. Recess 53 is in fluid communication with a radially disposed port 54 connecting to sleeve bore 2. A similar medium size recess 55 is located on generally the opposite side of tubular valve sleeve 34 from recess 53. Medium size recess 55 is in fluid communication with a port 56 that joins tubular valve sleeve bore 2. On the side of tubular valve sleeve 34 having medium size recess 53 is an additional medium size recess 57 at the upper end portion of the valve sleeve communicative by a port 58 with sleeve bore 2. Another medium recess 60 is located on the opposite side of the lower end portion of tubular valve sleeve 34 below recess 55 and it is communicative by port 59 with sleeve bore 2. Pressure sensing ports 47 and 52 in use provide communication of high pressure fluid to the appropriate ends of tubular valve sleeve 34 for shifting its longitudinal position within the cavity of tubular valve housing 61. Pressure sensing ports 46 and 51 in use provide for sensing fluid pressure from the low pressure side of the valve assembly (for the valve assembly shown in FIGS. 2–16) in order to position tubular valve sleeve 34 for operation in the throttling mode.

Tubular valve sleeve 34 is constructed in a symmetrical fashion with equivalent ports, passageways and areas on opposed ends thereof. This symmetrical equivalence is done to make operation of the reversing valve portion of the pump substantially identical for up and down strokes. Tubular valve sleeve 34 is constructed so that it has an effective area on its upper end which is substantially equal to the effective area on its lower end.

Valving mechanism 22 includes a generally tubular valve housing 61 which defines a hollow valve chamber enclosing tubular valve sleeve 34. Tubular valve housing 61 is constructed in three (3) threadedly joined segments which cooperate to form a valve chamber or cavity enclosing tubular valve sleeve 34. Tubular valve housing 61 includes an annular internal recess 62 around a mid-portion thereof which communicates with the plurality of power fluid inlet passages 24. Another internal annular recess 63 in the upper mid-portion of tubular valve housing 61 is in fluid communication with the lower end portion of upper pump cylinder 17 through a plurality of longitudinally disposed passages 64. Another similarly formed internal annular recess 65 communicates with the upper end of the lower pump cylinder 21 through a plurality of longitudinal passages 66. A small upper annular pressure communicating recess 67 is formed in the interior of tubular valve housing 61 spaced above annular recess 63 and opening to the bore of the housing. Another similarly formed lower annular pressure communicating recess 68 is formed in the lower mid-portion of housing 61 spaced below annular recess 65. Pressure communicating recesses 67 and 68 function to communicate fluid pressure between pressure sensing ports 51 and 46 and recesses 40 and 42 respectively during the throttling mode of operation. An upper fluid outlet from the valve chamber is formed by an annular fluid outlet recess 69 in the upper mid-portion of tubular valve housing 61 that joins the plurality of fluid outlet passages 70 which in turn communicate to the exterior of the housing. A similar lower annular fluid outlet recess 71 is formed in the lower portion of tubular valve housing 61 that joins a plurality of fluid outlet passages 72 which communicate to the exterior of the housing. Fluid from outlet passages 70 and 72 is directed by other passageways in bottom hole receptacle 12 to annular fluid return passage 14.

The exterior of tubular valve housing 61 has an annular seal ring 3 between power fluid inlet passages 24 and fluid outlet passages 70 for sealing the pump inside bottom hole receptacle 12. Another similar seal ring 4 is mounted around the lower exterior of the valve housing assembly between power fluid inlet passages 24 and the lower fluid outlet passages 72. Piston rod 19 is slidably mounted through valve mechanism 22 including tubular valve housing 61 and tubular valve sleeve 34. This slidable mounting is arranged to substantially seal fluid communication around the piston rod between the valve chamber defined within tubular valve housing assembly 61 and the piston chambers at the opposite ends thereof so there is a substantially negligible fluid leakage between several chambers align along the exterior of piston rod 19.

OPERATION

Generally, in regard to the following description of this pump's operation, the power fluid is assumed to be a liquid and supplied by a relatively high pressure fluid source and delivered to the subsurface hydraulic pump through power fluid conduit 13. In regard to this specific nature of the well fluid, it can be assumed to be a homogenious liquid although it is not limited to just that but may contain some gaseous material. In some portions of the following description, operation of the pump in a gas well fluid will be noted and discussed.

Concerning the general operation of this type pump, the piston assembly as well as the reversing valve are displaced by net forces which act either upwardly or downwardly on this specific member. These net forces are created as a result of fluid pressures acting on the effective areas of the specific member. For the piston assembly, it has effective areas on the upper side and lower side of each piston which are respectively acted upon by fluid in the upper and lower portions of the associated piston chambers. The piston assembly is moved only when there is a force imbalance on the entire piston assembly. In operation of the pump, the net force which causes the piston assembly to move is due to application of the relatively high fluid source pressure to the lower side of the upper piston or the upper side of the lower piston alternately by operation of the reversing valve mechanism.

In regard to the reversing valve mechanism, it to is only displaced when there is a net resultant force acting upon it which causes it to move. The tubular valve sleeve of the valve mechanism is constructed with equal effective areas on its upper and lower end so that its motion is influenced by the pressure changes which act on these equal effective areas.

Figure 2:
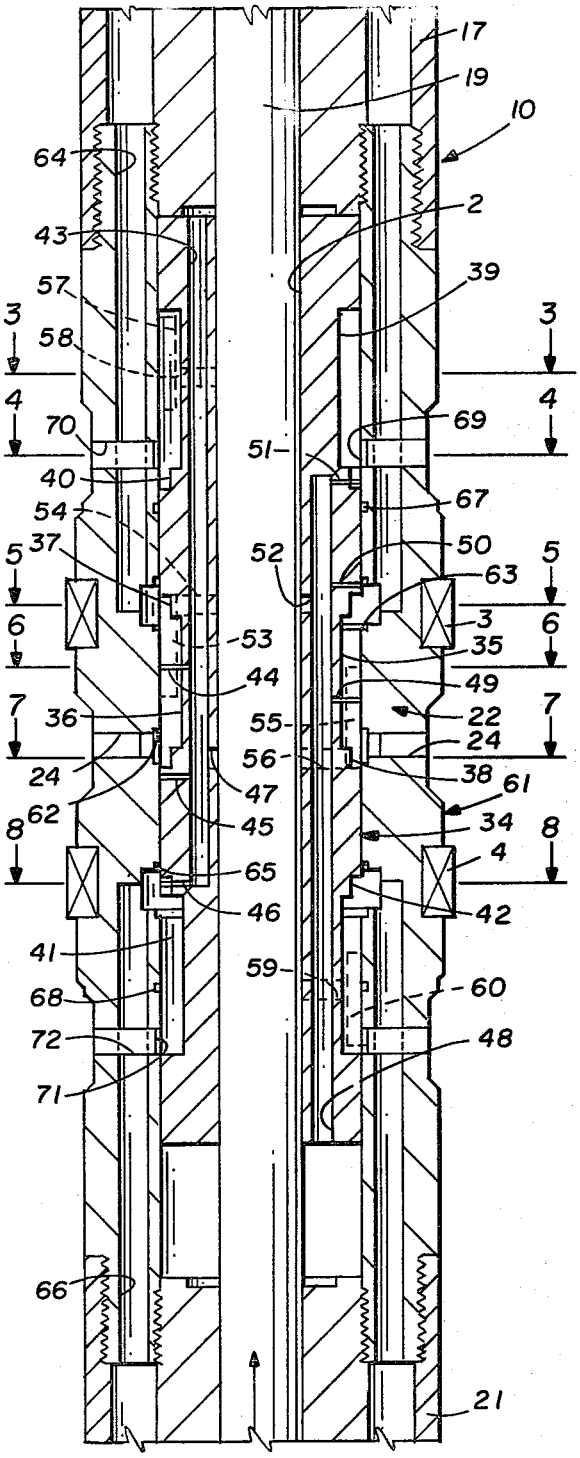
FIG. 2 is an enlarged schematic sectional view of the valving mechanism portion of the pump shown in FIG. 1.
Figure 3:
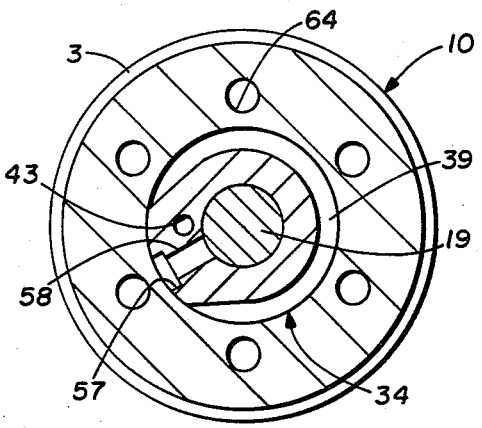
FIGS. 3, 4, 5, 6, 7 and 8 are transverse sectional views of the valving mechanism taken at lines 3—3, 4—4, 5—5, 6—6, 7—7 and 8—8 respectively from the pump shown schematically in FIG. 2.
Figure 4:
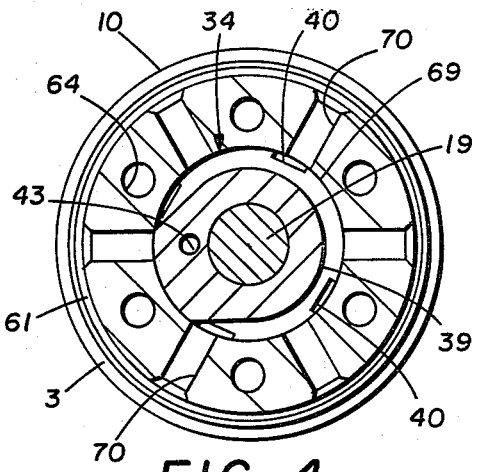
Figure 5:
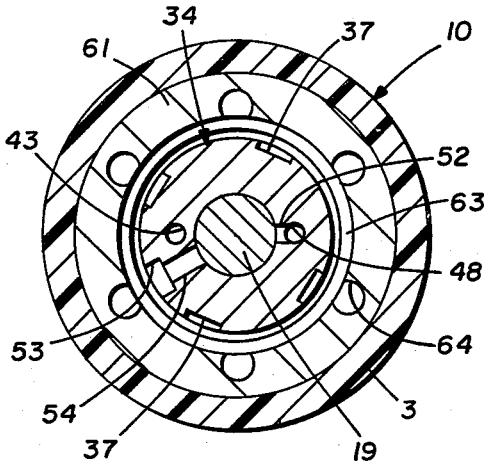
Figure 6:
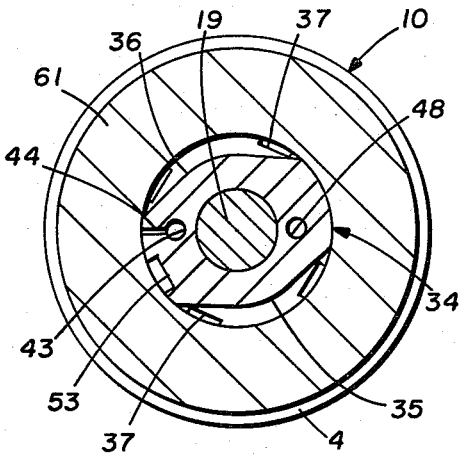
Figure 7:
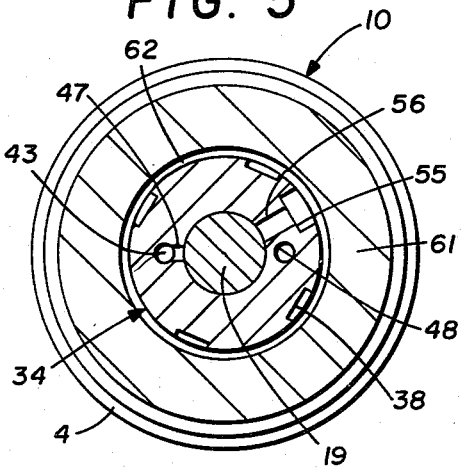
Figure 8:
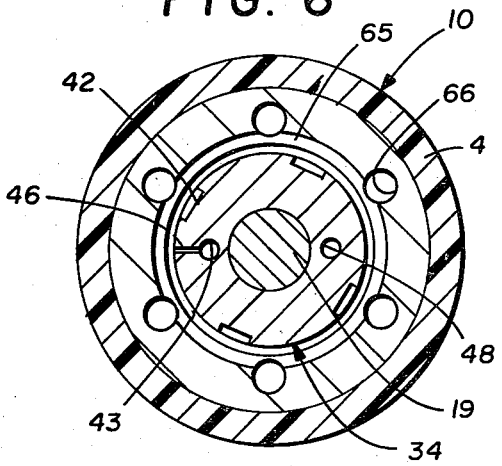

FIGS. 1 and 2 show the pump appropriately positioned for the upward motion of piston assembly 16. With the pump in this condition, power fluid at the relatively high fluid pressure is applied onto the lower portion of upper pump piston 18 thus forming an upwardly directly force acting on piston assembly 16. The pressure forces acting on piston assembly 16 at this time consists of the power fluid pressure applied to the lower portion of upper pump piston 18; a downwardly directed force on the upper surface of upper piston 18 due to well fluid within the annular fluid return passage 14; a downwardly directed force acting on the upper effective area of lower piston 20 due to fluid in the upper portion of lower pump cylinder 21 communicating with well fluid in annular fluid return passage 14; and a fluid pressure force acting on the lower effective area of lower piston 20 due to the fluid pressure in the formation fluid zone 15. The net upwardly directed force on piston assembly 16 due to the power fluid is assumed to be sufficient to overcome the downwardly directed force on the piston assembly.

In regard to fluid discharging from the pump, this will occur when there is sufficient fluid pressure in the upper portion of upper pump cylinder 17 above upper pump piston 18 to overcome the oppositely directed fluid pressure in fluid return passage 14. When this occurs, fluid will discharge into fluid return passage 14 through valve 26 and discharge passage 27 at the upper end portion of the pump upon upward motion of piston assembly 16. A similar action will occur in the lower portion of the pump below piston 20 and through valve 30 upon downward motion of pistion assembly 16.

In regard to well fluid entering the pump, it will pass from the fluid formation zone 15 through tubing standing valve 80 in bottom hole receptacle 12 when fluid pressure in the piston chamber is less than the pressure of the fluid in this zone. These fluid pressures may be within the lower portion of lower pump cylinder 21 upon upward motion of piston assembly 16 or within the upper portion of upper pump cylinder 17 upon downward motion of the piston assembly.

FIG. 2 shows the power fluid being applied to the lower portion of upper pump cylinder 17 thereby causing piston assembly 16 to move upwardly. Fluid reaches the lower portion of upper pump cylinder 17 by flowing from power fluid tube 13 through power fluid passage 25 on the exterior of the pump and via the plurality of circumferentially spaced radially disposed power fluid inlet passages 24 about the mid-portion of the pump into annular recess 62 around the interior of tubular valve housing 61. From this point, fluid flows through recess 35 and 36 in tubular valve sleeve 34 and upward through annular recess 63 into the plurality of longitudinal passages 64 communicating with the lower portion of upper pump cylinder 17. Meanwhile, fluid in the upper portion of lower pump cylinder 21 is communicated to fluid return passage 14 through the plurality of lower longitudinal passages 66, annular recess 65, recess 41 in tubular valve sleeve 34 and through the plurality of circumferentially spaced fluid outlet passages 72 extending radially through tubular valve housing 61. Fluid passing through outlet passages 72 enters an annular chamber around tubular valve housing 61 in the interior of bottom hole receptacle 12 whereupon it flows into return passage 14 through a plurality of ports extending radially through the lower portion thereof.

FIGS. 1 and 2 show the pump with valve mechanism 22 positioned for upward motion of piston assembly 16. In FIG. 1 when piston assembly 16 moves upward and valves 26, 28, 30 and 32 are positioned as shown, well fluid can flow from fluid formation zone 15 into lower pump cylinder 21 and exhausted or pumped fluid can flow from the upper portion of lower pump cylinder 21 and the upper portion of upper pump cylinder 18 respectively into fluid return passage 14.

Summarized briefly, the fluid action of the pump during upward motion of piston assembly 16 is as follows:

Fluid at a relatively high pressure is applied to the lower portion of upper pump cylinder 17 and fluid is exhausted from the upper portion of lower pump cylinder 21 and the upper portion of upper pump cylinder 17 while fluid is taken into the pump through the lower portion of lower pump cylinder 21.

The fluid in the upper portion of upper pump cylinder 17 is communicated to fluid return passage 14 through the passage between checkvalves 26 and 28 in the upper portion of the pump and passageway 27. Fluid pressure in the upper portion of upper pump chamber 17 is greater than the fluid formation zone pressure and the fluid pressure in return passage 14; therefore, checkvalve 28 is closed and checkvalve 26 is opened allowing fluid to pass through passageway 27 and through a plurality of openings in the upper portion of the bottom hole receptacle 12.

In the lower portion of the pump, formation fluid is taken from fluid formation zone 15 through the tubing standing valve, passed checkvalve 32 and into the lower portion of lower pump chamber 21. Provided the pressure in fluid return passage 14 is greater than the pressure in the lower portion of lower pump chamber 21 which is in turn less than the fluid formation zone pressure, then checkvalve 30 will close and there will be a passage of well fluid into the lower portion of the lower pump cylinder. Pressure within the lower portion of lower pump cylinder 21 is essentially that of fluid formation zone 15 but less due to upward motion of piston assembly 16. For embodiments of this valve mechanism having the throttling feature, this fluid throttling begins following each reversal of the piston assembly and may continue for the entire stroke or it may terminate at some position depending upon certain pressure conditions.

DETAILED OPERATION

Figure 9:
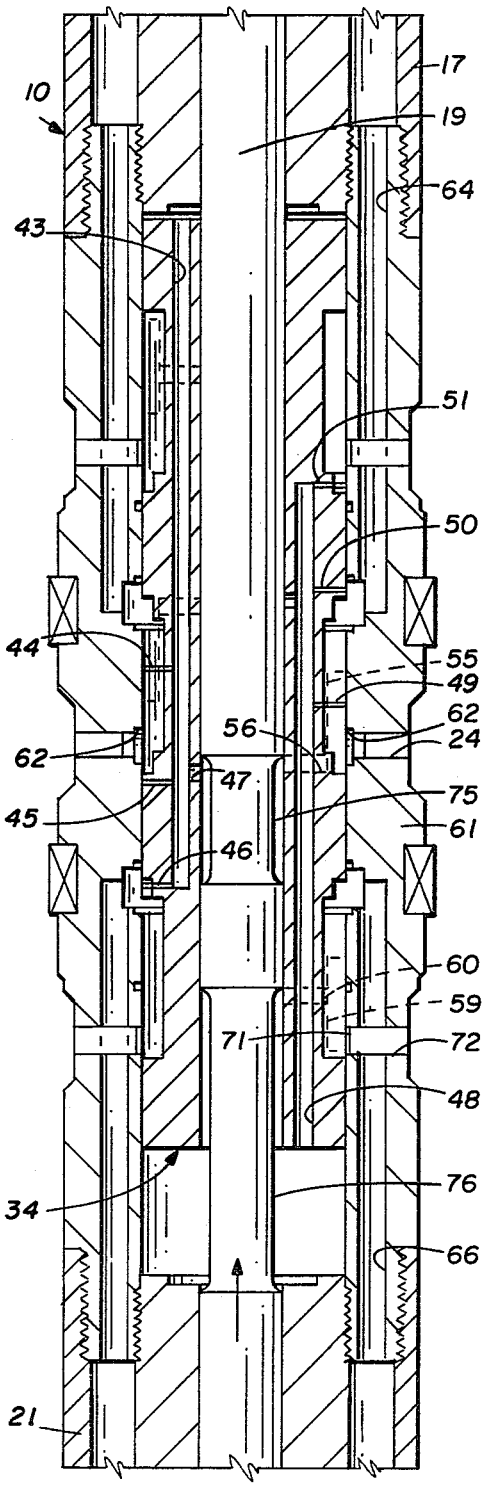
FIG. 9 is a schematic sectional view similar to FIG. 2, showing the piston assembly near its uppermost position and the generally tubular valve sleeve having initiated its downward movement.

FIG. 9 shows piston assembly 16 moving in the upward direction and near the end of the stroke with the lower portion of piston rod 19 located within tubular valve sleeve 34. FIG. 9 shows the valve assembly at the initiation of piston assembly reversal. With the pump in this position, piston rod 19 has moved up to a position whereby the relatively high pressure power fluid is communicated to the upper end of tubular valve sleeve 34 and a net downward force is acting upon the tubular valve sleeve. For details of the flow passages described in the following, reference should also be made to FIGS. 3–8 inclusive. This pressure arrangement is caused by power fluid passing through inlet passages 24 and annular recess 62 in tubular valve housing 61, then through medium size recess 55 and its connecting port 56 in tubular valve sleeve 34, then around piston rod shorter annular recess 75 to pressure shifting port 47 and tubular valve sleeve internal passageway 43.

This arrangement communicates fluid at the operating fluid pressure to the upper end of tubular valve sleeve 34 whereupon the fluid can act downwardly upon the effective area of the upper end of tubular valve sleeve 34. Also, in this position, fluid in return passage 14 is communicated through the valve mechanism to exert fluid pressure acting upwardly upon the lower effective area of tubular valve sleeve 34. This fluid is communicated by fluid passage 72 and annular recess 71 in the lower portion of tubular valve housing 61 then through medium size recess 59 and its connecting port 60 in tubular valve sleeve 34 to tubular valve sleeve bore 2 whereupon piston rod longer annular recess 76 permits this fluid to reach the lower end of tubular valve sleeve 34. Because fluid pressure on the upper effective area of tubular valve sleeve 34 is greater than the fluid pressure on the lower end of the member and because the effective areas are equal, this results in a net downward force acting on the tubular valve sleeve causing a downward motion thereof. It is to be noted that it is not necessary for tubular valve sleeve 34 to be in its uppermost position, or even its substantially uppermost position as shown in FIG. 9, for the passageways and the pressures to be arranged as described immediately above. This fluid connection occurs at the end of each stroke and it will occur whether tubular valve sleeve 34 is at the end of the valve chamber or displaced from the end of the valve chamber as it is during throttling.

Figure 10:
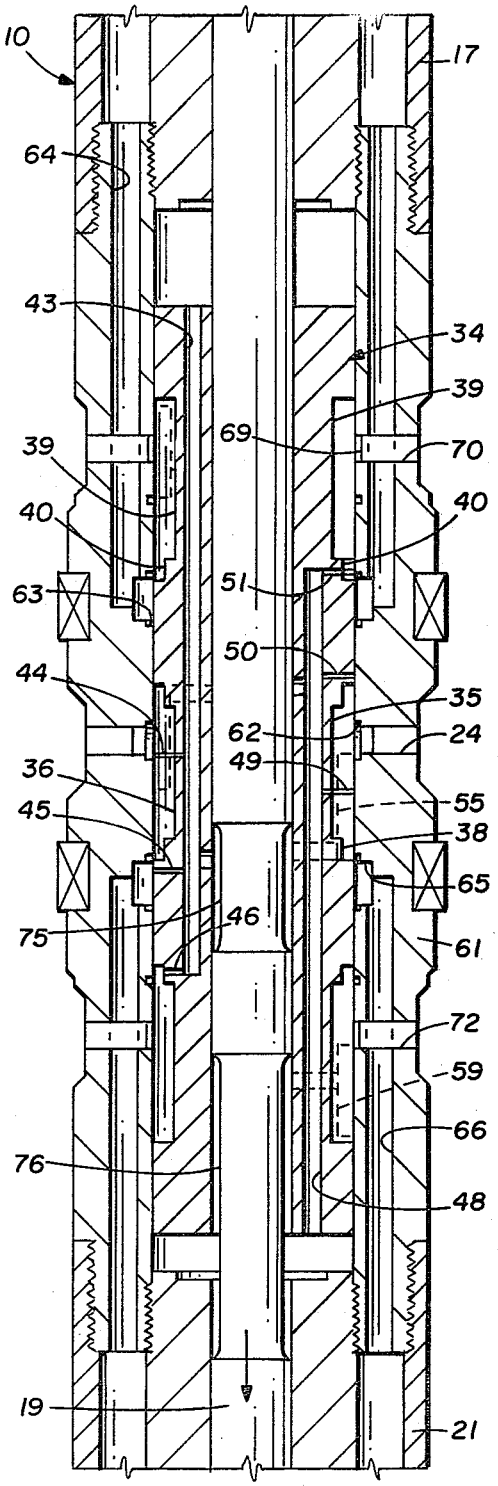
FIG. 10 is a schematic sectional view similar to FIG. 9, showing the piston assembly having initiated its downward movement and the generally tubular valve sleeve having moved further downward than shown in FIG. 9.

FIG. 10 shows tubular valve sleeve 34 and piston rod 19 after reversal wherein both are displaced downward from the piston shown in FIG. 9 and the piston assembly moving downward. FIG. 10 shows the tubular valve sleeve 34 having moved downwardly sufficient to terminate fluid communication of the relatively high pressure power fluid to the lower portion of upper pump cylinder 17, below upper pump piston 18, by blocking fluid communication between port 24 and recess 63. Also, with tubular valve sleeve 34 in this position, fluid communication is terminated between the upper portion of lower pump cylinder 21 and fluid return passage 14 by blocking fluid communication between recess 65 and port 72. When tubular valve sleeve 34 is positioned as shown in FIG. 10, power fluid is applied to the upper end of the lower pump cylinder 21 through power fluid inlets 24, large recess 35, annular recess 65 and passages 66. Also, spent power fluid is exhausted from the lower portion of upper pump cylinder 17 through passage 64, annular recess 63, large recess 39, annular recess 69 and upper fluid outlet passages 70 to fluid return passage 14. The overall result of this fluid communication is to place a downwardly directed fluid force on the piston assembly sufficient to overcome resistance of displacing well fluid from the lower portion of lower pump cylinder 21 into fluid return passage 14 and drawing well fluid into the upper portion of upper pump cylinder 17 through standing valve 80.

When the valve is in the position shown in FIG. 10, throttling of fluid flowing into the lower pump cylinder and out of the upper pump cylinder will occur simultaneously. This throttling occurs in the power fluid flow path by fluid passing through small throttling recesses 38 as it moves into annular recess 65 and passages 66. In the spent power fluid flow path, this throttling occurs by the fluid flowing through small throttling recesses 40 as it flows from passages 64 to large recess 39 and upper outlet passage 70. The throttling action is created by the positioning of tubular valve sleeve 34 such that fluid flow is restricted by an orifice like restriction formed between each of these small recesses, the associated annular recess and port opening within the tubular valve housing.

It is very important to note that upon reversal of the piston assembly, any one of several separate and distinct loading conditions for the pump may occur depending upon the particular operating condition of the pump. Awareness of these loading conditions is essential in order to understand how the reversing valve mechanism of this invention reacts to different loading conditions.

The first condition is when the pump is fully loaded with liquid. When the pump operates in this condition and the piston assembly reverses direction, the forces which were acting on the piston assembly and the reversing valve mechanism while the piston was traveling in one direction are immediately reversed when the piston assembly changes direction. This operating condition is perhaps the most desirable because the pump cylinders are continuously full and that the pump operates at its maximum efficiency. Normally, when a pump is operating in fully liquid loaded condition, you will operate at full speed with throttling occurring to reduce the piston velocity only during the portion of the stroke immediately prior to reversal.

The second condition is a partially liquid loaded condition which occurs when the pump is operating faster than fluid can move into the pump and fill the piston cavity. When the reversal of piston motion occurs, the compression piston faces no resistance to movement and the suction piston has a low resistance to movement therefore, a low resistance pressure is present on each end of the piston assembly. This condition is commonly known as a cavitation condition or when the liquid is exposed to a pressure below its vapor pressure and this in effect creates a cavity within the piston chamber between the piston and the liquid portion of the fluid. This is the worse condition, forcewise, because once the piston moves sufficient to close the cavity then the liquid must be pressurized immediately up to the discharge pressure when the piston reaches the end of the cavity. When the piston reaches the end of the cavity, then the so called "fluid pound" occurs and this creates fluid induced dynamic loading forces in the fluid as well as the pump structure. These dynamic forces are typically damaging to hydraulic well pumps and can lead to structural failures.

The third condition is a gas interference condition or more specifically a loading condition wherein liquid and a gas are present in the well and pass through the pump. When piston reversal occurs, it does not necessarily change the forces appreciably on the piston assembly because of the compressed gas contained within the pump cylinder which had previously been on the compression stroke. Because of the presence of gas, the fluid forces change more slowly than when only liquid is present in the pump. In the gas interference condition, the suction piston is exposed to a pressure due to compressed gas contained within the pump cylinder from the prior stroke until it has traveled sufficiently to expand this gas to a non-compressed condition and then continue to create a suction pressure for drawing additional fluid into the pump. In this condition on the compression piston because it is exposed to gas, the resistive force on this piston increases at a slower overall rate than it does when the pump is fully loaded with liquid or during the operation in the cavitation condition. In other words, the compression piston is exposed to a cushion when the pump is operating in the gas interference condition.

The fourth condition is a dry hole condition when no liquid or no significant amount of fluid is drawn into the pump because of a lack of fluid within the well or in obstruction to the pump inlet. When the pump is operating in this condition, the only significant forces acting on the piston assembly are due to the power fluid thus when reversal of the piston assembly occurs, forces due to compression and suction action of the piston assembly are negligible and the piston assembly will reciprocate without encountering a significant resistive force while moving in either direction. Because of the lack of a resistive force, the reversing valve mechanism of this invention will operate in its throttle mode during the entire length of each stroke.

In regard to operation of the pump, without regard to the particular loading condition, at termination of upper movement of piston assembly 16, a well fluid net downward force acts on the piston assembly. This net force is caused by fluid pressure in the upper portion of the upper pump cylinder which is equivalent to the pressure in return passage 14 which acts downwardly on the effective area of the upper end of upper piston 18. Also, fluid pressure equivalent to the pressure in formation zone 15 acts upwardly on the effective area of the lower end of lower pump piston 20. The well fluid force on piston assembly 16 during its downward movement changes from the described downwardly directed net force to an essentially equal and upwardly directed force when fluid below the lower or compression piston becomes equivalent to the pressure in fluid return passage 14. When the pressure below the lower or compression piston becomes greater than the pressure in return passage 14, then fluid from the pump flows into the return passage.

During downward movement of piston assembly 16 and the transition from a well fluid downwardly directed net resisting force to an upwardly directed net resisting force, the pressure of fluid in upper portion of lower pump cylinder is increased and the pressure of fluid in the lower portion of upper pump cylinder is decreased.

Figure 11:
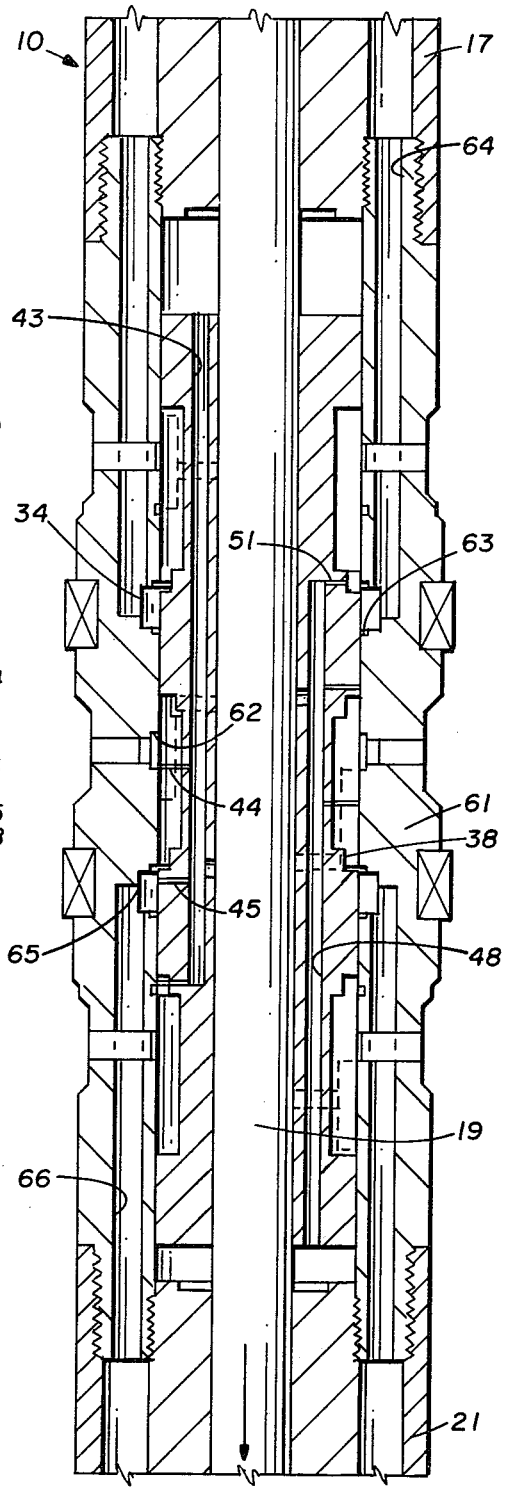
FIG. 11 is a schematic sectional view similar to FIG. 10, showing the piston assembly and the generally tubular valve sleeve having moved further downward than shown in FIG. 10.

FIG. 11 shows tubular valve sleeve 34 displaced slightly downward within tubular valve housing 61 from the position shown in FIG. 10 and piston rod 19 also displaced downward from the position shown in FIG. 10 to a position wherein a uniform diameter portion of the piston rod extends through the tubular valve sleeve. Movement of tubular valve sleeve 34 to the position shown in FIG. 11 causes termination of fluid communication between medium recess 55, located in the mid-portion of the valve sleeve, and annular recess 62 inside tubular valve housing 61 and it also causes termination of fluid communication between medium size recess 59, in the lower portion of the valve sleeve, and annular recess 71 within the tubular valve housing at passageway 72. Additionally, downward movement of tubular valve sleeve 34 causes fluid communication of presssure sensing port 51 with tubular valve housing annular recess 63; communication of pressure sensing port 45 with tubular valve housing annular recess 65 and communication of pressure sensing port 44 with tubular valve housing annular recess 62. Power fluid is communicated to the effective area of the upper end of tubular valve sleeve 34 through power fluid passages 24 and annular recess 62 in tubular valve housing 61 and through pressure sensing port 44 and tubular valve sleeve internal passage 43. Fluid from the lower portion of upper pump cylinder 17 is communicated to the effective area of the lower end of tubular valve sleeve 34 through passage 64, pressure sensing port 51, and tubular valve sleeve internal passage 48. This fluid connection applies fluid at essentially the power fluid pressure to the upper end of tubular valve sleeve 34 and fluid at substantially the pressure in return passage 14 to the lower end of tubular valve sleeve 34. Because the pressure of the power fluid is greater than the pressure of fluid exhausted from the lower portion of the upper pump cylinder, the tubular valve sleeve is displaced downward due to a downwardly directed net force occurring as a result of this pressure differential. It is to be noted that at the time of the piston assembly reverses its motion, the fluid forces applied to the tubular valve sleeve are reversed substantially instantly and the tubular valve sleeve is immediately displaced downward from the position shown in FIG. 9 toward the positions shown in FIGS. 11 and 12. The distance which tubular valve sleeve 34 travels downwardly depends upon the forces applied to its opposite ends. When the tubular valve sleeve is in the position shown in FIG. 11, the power fluid flowing into the upper portion of lower pump cylinder 21 is throttled due to the flow restriction presented between shallow recesses 38 and lower tubular valve housing annular recess 65 which connects to tubular valve housing passageways 66 thereby limiting fluid flow into the upper portion of lower pump cylinder 21 and in turn limiting the piston velocity.

Figure 12:
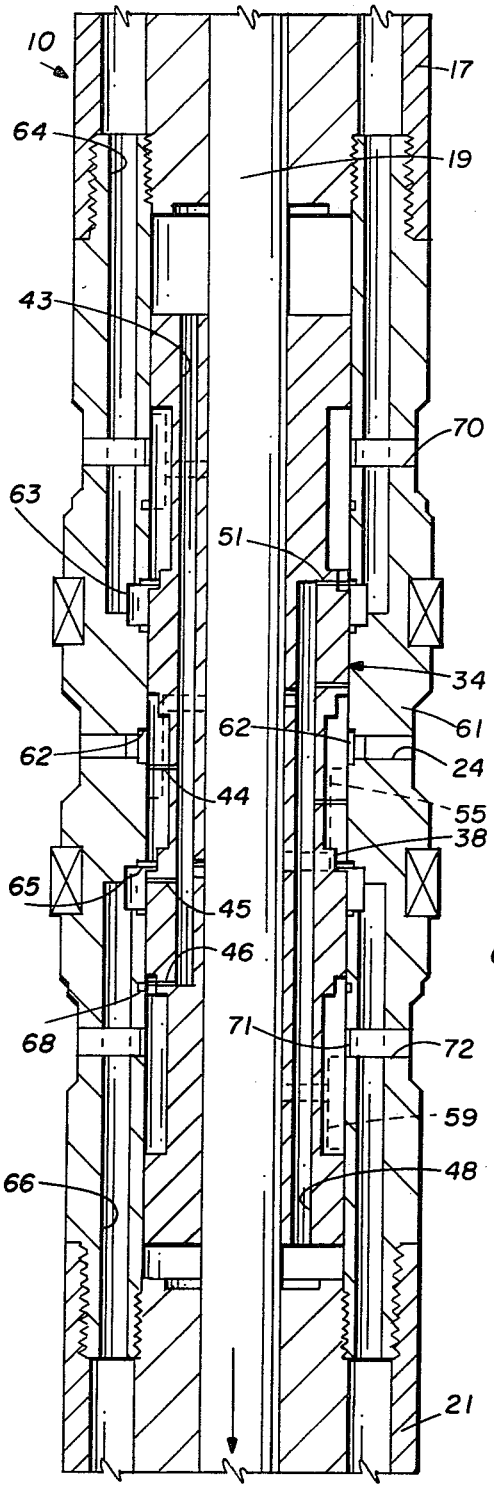
FIG. 12 is a schematic sectional view similar to FIG. 11, showing the generally tubular valve sleeve having moved further downward than shown in FIG. 11.

FIG. 12 shows tubular valve sleeve 34 positioned slightly downward in tubular valve housing 61 from the position shown in FIG. 11. When tubular valve sleeve 34 moves to the position shown in FIG. 12, this terminates fluid communication of the power fluid to the upper end of the tubular valve sleeve by closing the connection of pressure sensing port 44 and annular recess 62. For the position shown in FIG. 12, fluid communication to the upper end of tubular valve sleeve 34 is from the upper portion of lower pump cylinder 21 through passages 66, pressure sensing port 45 and internal passages 43. Fluid communication to the lower end of tubular valve sleeve 34 is the same as shown in FIG. 11. Therefore, with the tubular valve sleeve in this position, the fluid pressure acting downwardly on the upper end of tubular valve sleeve 34 is substantially the fluid pressure in the upper portion of lower pump cylinder 21 and the pressure acting upwardly on the lower end of tubular valve sleeve 34 is essentially the pressure in the lower portion of upper pump cylinder 17. Tubular valve sleeve 34 is urged in a downward direction because the power fluid communicated into the upper portion of lower pump cylinder 21 is at a higher pressure than the spent power fluid being exhausted from the lower portion of upper pump cylinder 17. The resistive force acting against the downward bias presently acting on tubular valve sleeve 34 is due to the spent power fluid from the lower portion of upper pump cylinder 17 being applied to the lower end of the tubular valve sleeve. Tubular valve sleeve 34 remains in approximately the position shown in FIG. 12 so long as the pressure in the lower portion of lower pump chamber 21 is essentially equal to the pressure in the upper portion of upper pump chamber 17. Notice that in FIG. 12, pressure sensing port 46 at the lower end of tubular valve sleeve internal passage 43 is positioned slightly above tubular valve housing annular internal communicating recess 68 and this prevents fluid communication between fluid which is essentially at the pressure in fluid return passage 14 with the upper end of the tubular valve sleeve.

Figure 13:
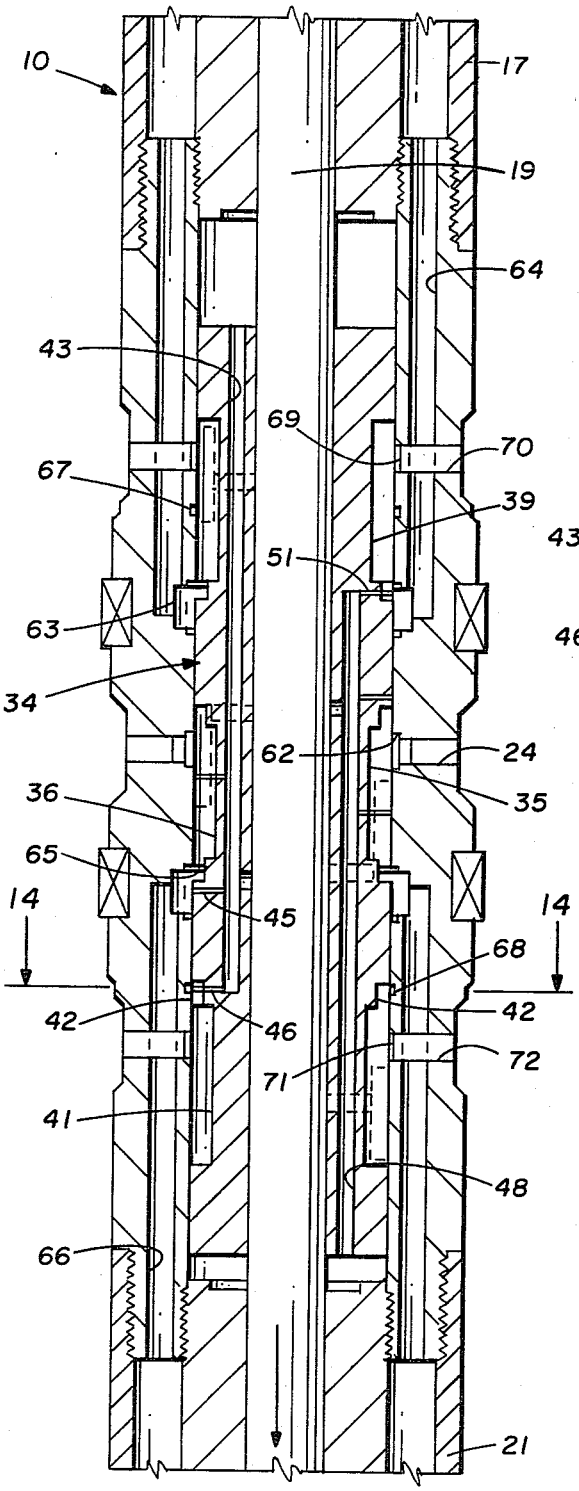
FIG. 13 is a schematic sectional view similar to FIG. 12, showing the generally tubular valve sleeve having moved further downward than shown in FIG. 12 to the throttling position.
Figure 14:
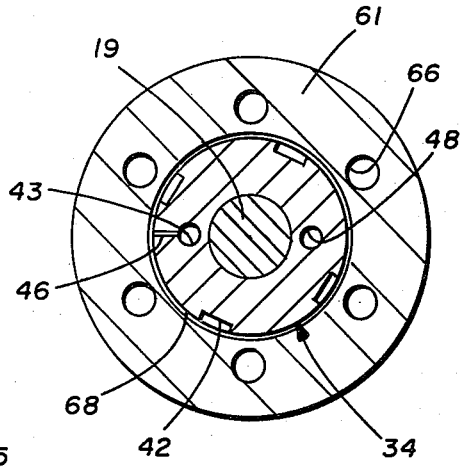
FIG. 14 is a transverse sectional view of the valving mechanism taken at line 14—14 in FIG. 13.

FIG. 13 shows tubular valve sleeve 34 displaced slightly downward from the position shown in FIG. 12 and assuming a position wherein fluid communication is established between fluid return passage 14 and the upper end effective area of tubular valve sleeve 34 due to the alignment of recess 68 and pressure sensing port 46. The tubular valve sleeve remains approximately in the position shown in FIG. 13 until the upwardly directed resisting force on the piston assembly becomes essentially the pressure of the fluid in return passage 14 (which assists in acting downwardly on the upper end of the tubular valve sleeve) and the resistive fluid pressure above the upper pump piston becomes essentially the fluid formation zone pressure. If this pressure condition occurs, then tubular valve sleeve 34 is displaced further downward to the position shown in FIG. 15 because the fluid pressure applied to the upper end of the tubular valve sleeve (a pressure higher than that in fluid return passage 14 due to sensing ports 45 and 46) is greater than the fluid pressure applied to the lower end thereof (the spent power fluid pressure in the lower portion of the upper pump cylinder).

Figure 15:
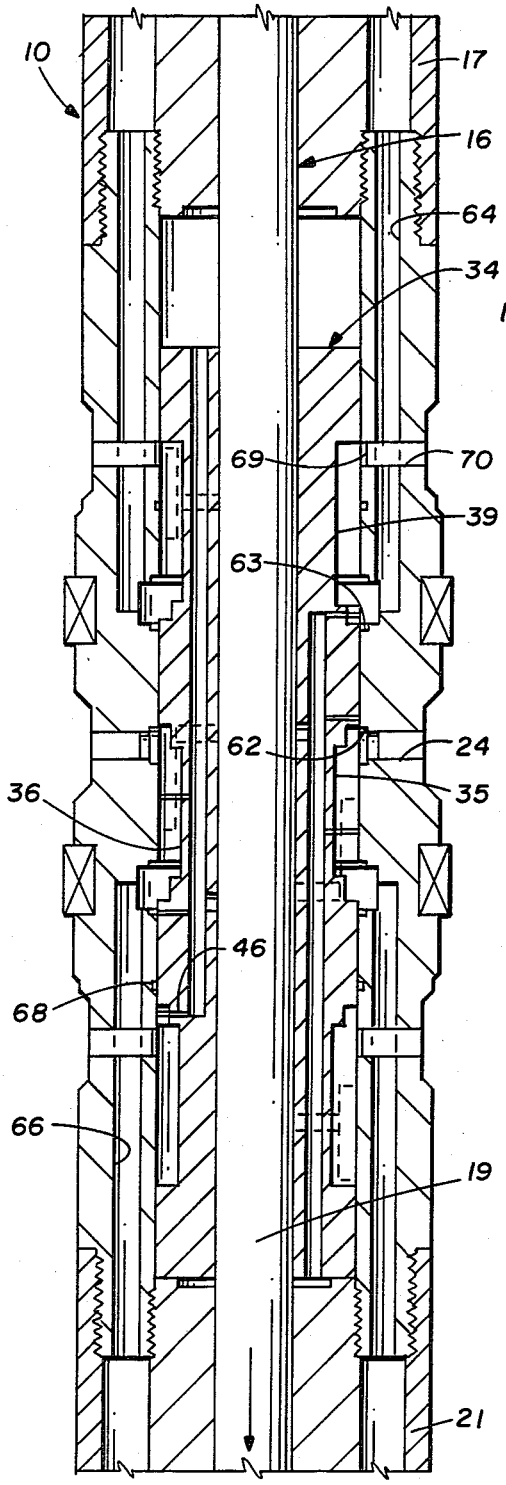
FIG. 15 is a schematic sectional view similar to FIG. 13, showing the generally tubular valve sleeve in its lowermost position.

It is to be noted that the shifting of tubular valve sleeve 34 from the position shown in FIG. 13 to the position shown in FIG. 15 will not occur until the fluid pressures are as explained above. Additionally, so long as the tubular valve sleeve remains in the position shown in FIGS. 11, 12 and 13, the pump will function in the throttling mode of operation. For the above described operating conditions, tubular valve sleeve 34 will be positioned for throttling during the initial portion of the partially loaded operating condition until the pump becomes fully liquid loaded or until the cavitation condition no longer exists. Also, the pump will operate in the throttling mode during the gas interference condition until the pump becomes fully liquid loaded if such does occur. Additionally, the pump will operate in the throttling mode during the dry hole operating condition because the formation zone fluid pressure will always be substantially less than fluid pressure in the return passage provided a column of liquid is present in this passage.

In the event that tubular valve sleeve 34 is moved downward to the position shown in FIG. 15, this allows substantially unrestricted flow of the power fluid from power fluid inlet passages 24 through large recess 35 and into the upper portion of lower pump cylinder 21 and it also allows similar substantially unrestricted fluid flow from the lower portion of upper pump cylinder 17 through large recess 39 to power fluid upper outlet passages 70 for communication to fluid return passage 14. Tubular valve sleeve 34 is maintained in this position because the fluid pressure applied to its upper end (a pressure substantially equivalent to the power fluid pressure) is greater than the fluid pressure applied to its lower effective area (a pressure substantially equivalent to that in fluid return passage 14). Once tubular valve sleeve 34 moves to the position shown in FIG. 15, it will remain in this position until the piston assembly is displaced sufficient to position piston rod 19 as shown in FIG. 16 and at which time another reversal of the piston assembly in the tubular valve sleeve will occur.

Figure 16:
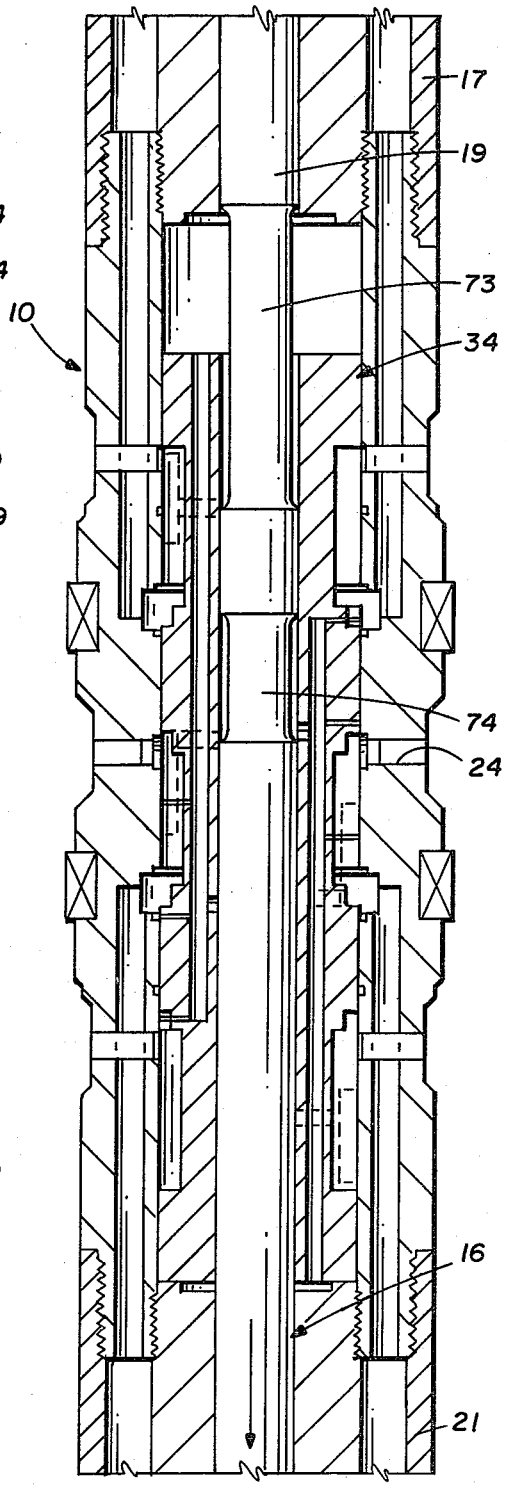
FIG. 16 is a schematic sectional view similar to FIG. 15, showing the piston assembly in its lowermost position and the piston rod positioned and ready to reverse its direction of motion.
Figure 17:
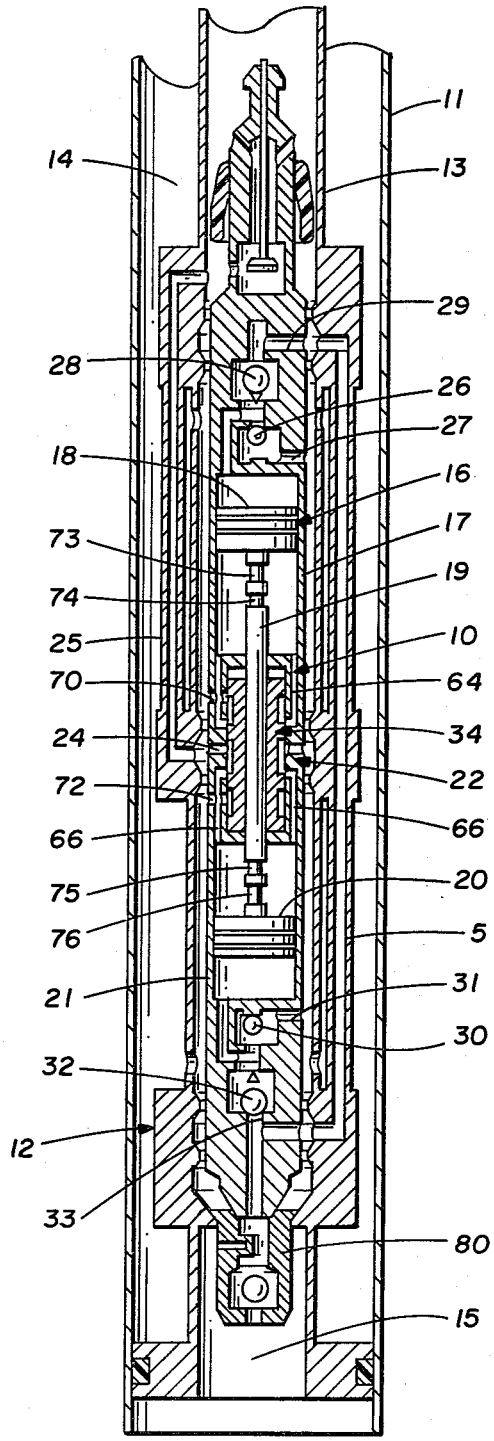
FIG. 17 is a schematic vertical cutaway elevation view similar to FIG. 1, illustrating the pump and the associated valves during the upward movement of the piston assembly.
Figure 18:
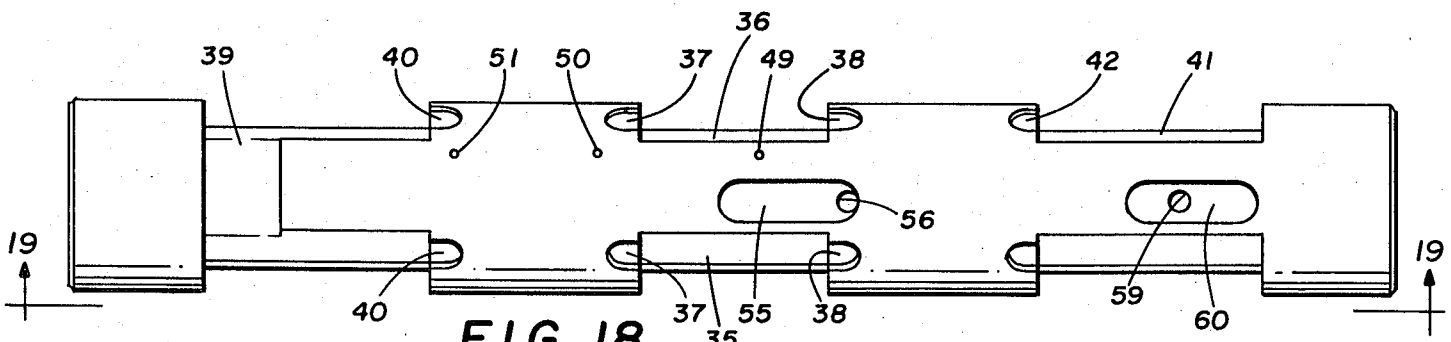
FIG. 18 is an elevation view of the tubular valve sleeve taken from a side having the medium sized recesses.
Figure 19:
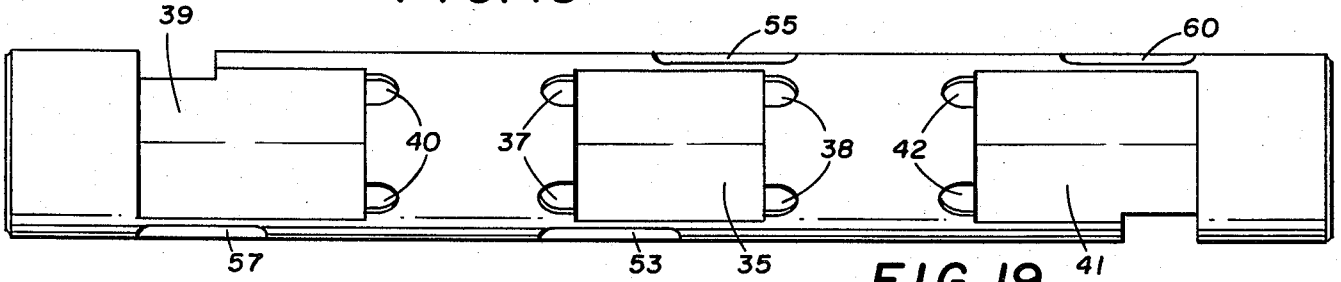
FIG. 19 is an elevation view of the tubular valve sleeve taken from the position of line 19–19 in FIG. 18.

Referring to FIG. 16, the piston assembly 16 having moved downward to a position whereby the annular recess 73 and 74 have caused communications in an oppositely likewise manner as that caused by the annular recesses 76 and 75 as described above, the resultant movement of the generally tubular valve sleeve 34 as well as the subsequent movements thereof and the movements of the piston assembly 16 are caused in an oppositely likewise manner of that also described above.

Figure 21:
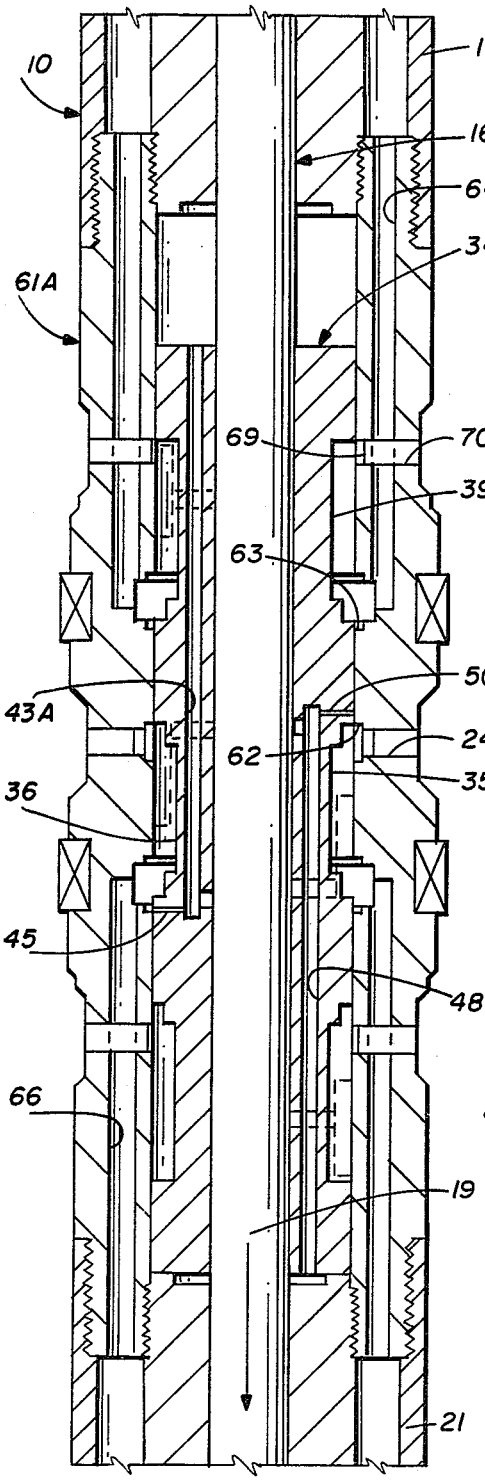
FIG. 21 is a schematic sectional view of an alternate embodiment of the valving mechanism without provisions for throttling.
Figure 22:
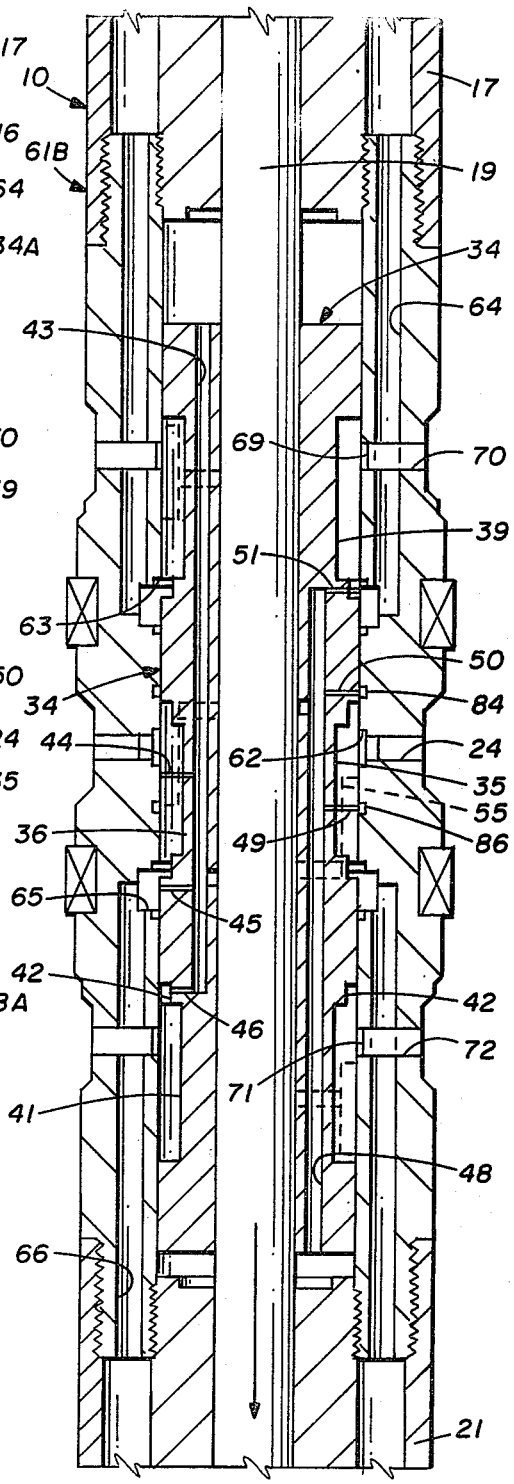
FIG. 22 is a schematic sectional view of an alternate embodiment of the valving mechanism utilizing high pressure for throttle mode operation sensing.
Figure 23:
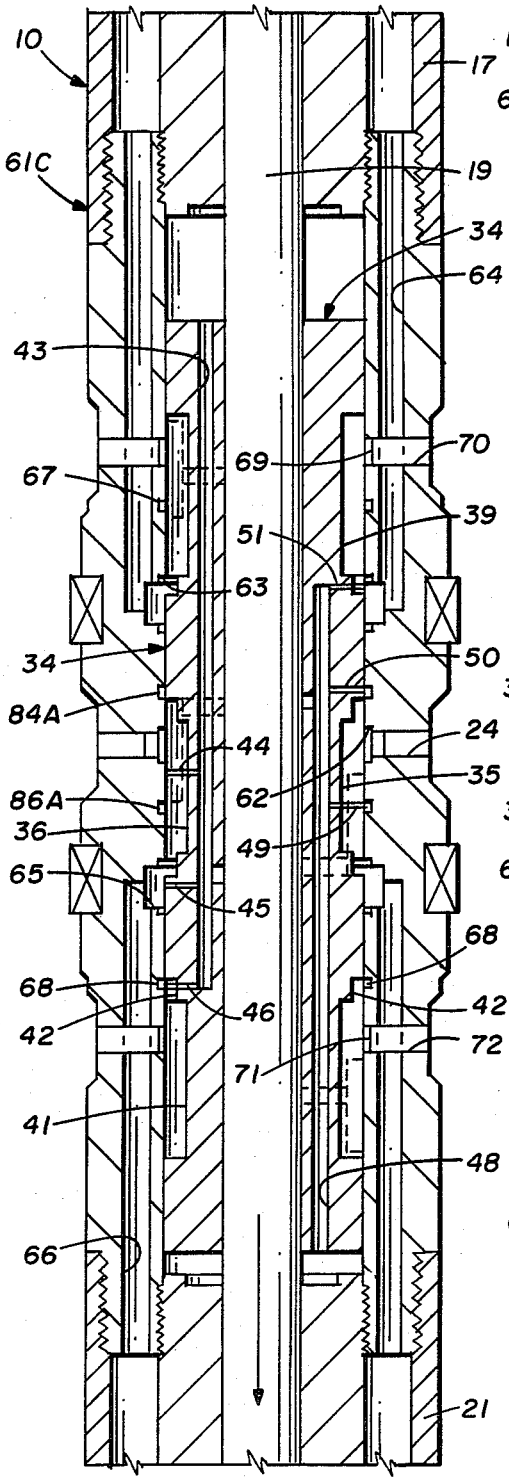
FIG. 23 is a schematic sectional view of an alternate embodiment of the valving mechanism utilizing both high and low pressures for throttle mode operation sensing.
Figure 24:
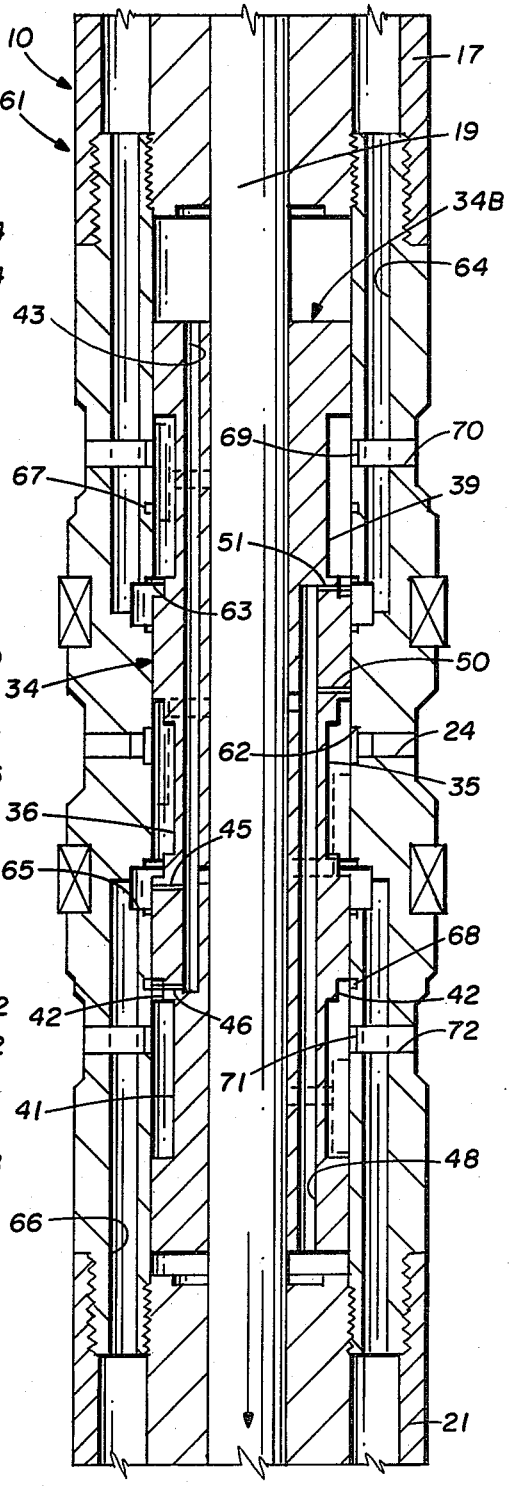
FIG. 24 is a schematic sectional view of an alternate embodiment of the valving mechanism utilizing low pressure for throttle mode operation sensing but without a maximum piston velocity throttle limit.

FIGS. 21–24 show some alternate embodiments of the reversing valve mechanism of this invention. FIG. 21 shows the reversing valve mechanism without provisions for operating in the throttle mode. FIGS. 22, 23 and 24 show the reversing valve mechanism with provisions for operating in the throttle mode and with alternative pressure sensing schemes utilized for determining the condition at which the throttling mode is terminated.

In FIGS. 21–24, the same reference numerals are used as in the prior figures except for identification of modified or additional elements.

In regard to FIG. 21, the tubular valve housing is constructed with the valve chamber thereof not having the pressure sensing annular recesses the upper and lower portions thereof as shown in FIG. 2 and indicated at 67 and 68. Also, tubular valve sleeve 34A is constructed without the pressure sensing ports 44 and 49 transverse through the midportion thereof as shown in tubular valve sleeve 34 in FIG. 2. With the reversing valve mechanism constructed as shown in FIG. 21, there is no provision for the application of a resistive fluid force to tubular valve sleeve 34A when the reversal occurs, therefore, the tubular valve sleeve is displaced to the end of the valve chamber upon the reversal. The elimination of this resistive force is accomplished by removing the fluid connection which in the preceeding embodiment maintained the resistive fluid pressure by communicating with the end of the tubular valve sleeve having the resistive force applied thereto by the spent power fluid. In tubular valve sleeve 34A, communications with the ends thereof is accomplished by a single pressure sensing port and the associated internal passageway rather than the plurality of pressure sensing ports and the internal passageway. On the left side of FIG. 21, pressure sensing port 45 communicates from the exterior of tubular valve sleeve 34A to internal passage 43A for communicating power fluid from the downwardly directed fluid path to the upper end of the tubular valve sleeve. On the right side of FIG. 21, pressure sensing port 50 communicates from the exterior of tubular valve sleeve 34A through internal passage 48A to the lower end of the tubular valve sleeve. With this fluid communicating arrangement, power fluid is transmitted from the power fluid flow path through pressure sensing port 45 and internal passage 43A to the upper end of the tubular valve sleeve whereas no fluid pressure is transmitted through pressure sensing port 50 and internal passage 48A to the lower end of the tubular valve sleeve, therefore, the net force on the tubular sleeve is downward so it is maintained in the position shown until piston rod recess 73 and 74 enter the tubular valve sleeve and alter this fluid arrangement by applying the power fluid to the lower end of the tubular valve sleeve and exhausting fluid from the upper end of the tubular valve sleeve thereby shifting it to the opposite end of the valve chamber and reversing the fluid flow path to reverse the direction of motion of the piston assembly. Therefore, in this embodiment of the reversing valve mechanism, tubular valve sleeve 34A is not temporarily positioned in a mid-portion of the valve chamber to throttle the power fluid and the spent power fluid so the piston assembly is displaced at its full speed velocity at all times.

FIG. 22 shows an embodiment of the reversing valve mechanism of this invention which is constructed to operate in the same manner as the first described embodiment of the invention yet instead of sensing a lower pressure to terminate operation in the throttle mode, this embodiment comparatively senses a high pressure for terminating operation in the throttle mode. In this embodiment of the reversing valve mechanism, tubular valve sleeve 61B is provided with an upper pressure sensing annular recess 84 within the bore of the tubular valve sleeve chamber slightly spaced above annular recess 62 communicating with power fluid inlet ports 24. Also as similar lower pressure sensing annular recess 86 is positioned between annular recess 65 and annular recess 62. Annular recesses 84 and 86 are substantially equally positioned from power fluid inlet ports 24 in keeping with the symmetrical construction of the valve mechanism. The tubular valve sleeve 34 is the same construction as described in the preceeding (except FIG. 21) and moves to the location shown in FIG. 22 when operating in the throttling mode. The position of the tubular valve sleeve in FIG. 22 corresponds to the position of the tubular valve sleeve in FIG. 13. In FIG. 22 when tubular valve sleeve 34 is positioned as shown, the upper end effective area of the tubular valve sleeve is exposed to the high pressure power fluid via pressure sensing passage 45 and internal longitudinal passage 43 and the lower end effective area of the tubular valve sleeve is also high pressure power fluid as well as the spent power fluid. The power fluid entering passages 24 passes around large recess 35 and in turn into lower pressure sensing annular recess 86 whereupon it is communicated to pressure sensing passage 49 and internal longitudinal passage 48. The affect of communicating power fluid to the lower effective area of tubular valve sleeve 34 is to artificially raise fluid pressure acting on the lower effective area of the tubular valve sleeve. This affect has the same result as artificially lowering the pressure on the opposite end of the tubular valve sleeve which is accomplished by pressure sensing annular recesses 67 and 68 in the valve mechanism shown in FIG. 13. Placing the pressure sensing annular recesses as shown at 84 and 86 does not alter the overall operation of the valve mechanism from that described in the preceeding nor does it alter the pressure conditions which must be present for the tubular valve sleeve to shift from the throttling mode to the fully loaded or full velocity operating condition.

FIG. 23 shows another embodiment of the reversing valve mechanism of this invention which is constructed to operate in the same manner as the first described embodiment of the invention, yet instead of obtaining positioning of the tubular valve sleeve by artificially raising or lowering pressures acting on the effective upper and lower end of the tubular valve sleeve, this embodiment alters the pressure on both ends of the tubular valve sleeve. In this embodiment, the tubular valve housing is inidicate at 61C and includes two sets of pressure sensing annular recesses. One set of pressure sensing annular recesses are those indicated at 67 and 68 which function as described above to artificially lower the pressure acting on the effective area of the tubular valve sleeve which is subjected to the higher pressure when the valve mechanism is positioned in the throttling mode. The other set of pressure sensing annular recesses are those indicated at 84A and 86A which function as described above to artificially raise the pressure acting on the effective area of the tubular valve sleeve which is subjected to the lower pressure when the valve mechanism is positioned in the throttling mode. In operation of the valve mechanism of this invention, the two sets of annular recesses function cooperatively with passages in the tubular valve sleeve and tubular valve housing 61C to operate the reversing valve mechanism. When tubular valve sleeve 34 is positioned as shown in FIG. 23, the fluid pressure acting downwardly on the upper effective area of tubular valve sleeve 34 is artificially lowered by the fluid communication through longitudinal passage 43, pressure sensing passage 46, annular pressure sensing recess 46, large annular recess 41, and lower fluid outlet passage 72 communicating with annular return passage 14. Also, the fluid pressure acting upwardly on the lower effective area of tubular valve sleeve 34 is artificially raised by the communication through longitudinal passage 48, pressure sensing passage 49, lower pressure sensing annular recess 49, and large recess 35 which is in fluid communication with the plurality of power fluid inlet ports 24 through annular recess 62. The gross affect of using both sets of pressure sensing annular recesses is to so modify the pressure forces acting on tubular valve sleeve 34 that it is subjected to a redundant pressure control influence which will cause it to operate in the same overall manner as the valve mechanism shown and described in FIGS. 13 and 22.

FIG. 24 shows another embodiment of the reversing valve mechanism of this invention which is constructed with a modified pressure sensing passage construction in the tubular valve sleeve which provides for repositioning of the tubular valve sleeve should the pressure conditions affecting motion of the tubular valve sleeve be so altered as to cause it to reverse direction of motion before the piston assembly reaches the normal reversing position. This embodiment, tubular valve sleeve 34B, is constructed substantially the same as shown and described in the preceeding with the exception of the pressure sensing passages communicating to the ends thereof. Longitudinal passage 43 is provided with only two pressure sensing passages, indicated at 45 and 46, communicating to the exterior of the tubular valve sleeve. Likewise, longitudinal passage 48 is only provided with two pressure sensing passages, indicated at 50 and 51, communicating to the exterior of the tubular valve sleeve. This arrangement of pressure sensing passages permits the valve mechanism to operate substantially the same as that described in conjunction with FIG. 13, however, in the event that pressure conditions on the ends of the tubular valve sleeve are such that it is backed up or moved upwardly from the position shown in FIG. 24 (this is the opposite direction to its present direction of travel), then pressure sensing passage 45 will provide fluid communication to the power fluid entering passage 66 to the lower pump cylinder while pressure communication from pressure sensing passage 46 is terminated as it moves above annular pressure sensing recess 68. This fluid communication will cause the pressure acting on the upper effective area of tubular valve sleeve 34B to be substantially increased thereby creating a larger downwardly directed force on tubular valve sleeve 34B thus displacing it downward (in its original present direction) to the approximate position shown in FIG. 24 whereupon continued operation of the valve mechanism in the throttling mode may continue. Pressure sensing passages 50 and 51 function similarly when the valve is in the upward displaced position and the piston rod is moving upwardly.

In regard to the operation of all the described embodiments of this invention, it is to be emphasized that the pump including the reversing valve mechanism is a symmetrical structure and because of this in both the upper and lower portions thereof are identical, therefore, the reversing valve mechanism and its inherent servo control valve sleeve positioning system will operate the same regardless of whether the piston assembly is moving upwardly or downwardly. In order to avoid repetition in the description, a complete cycle or series of cycles is not described in full detail because it would be redundant.

From the foregoing description of the applicant's reversing valve and all the features thereof, it is seen that it provides an extremely versatile apparatus for controlling the motion (including the velocity) of the piston assembly in a downhole fluid operated well pump. This reversing valve mechanism provides for running of the pump in a velocity controlled and regulated operating sequence which will prevent the occurrence of forces which would possibly damage or destroy the pump structure. Also, this reversing valve mechanism is constructed such that it will compensate for operation of the pump in a fully loaded condition, a partially loaded condition, a gas interference condition and in a dry hole operating condition due to the unique valve mechanism and its associated fluid throttling control systems.

The embodiments of the invention in which an exclusive property or privilege is claimed are defined as follows:

1. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by recess portions of said tubular valve sleeve and fluid passages in said tubular valve housing to regulate fluid flow in the flow path of the power fluid for regulating the velocity of said piston means; and (c) means to control said power fluid throttling means having means to sense a pressure differential between said power fluid and said spent power fluid pressures within both said upper and lower piston means for each direction of travel of said piston means and to said pressure differential to so position said tubular valve sleeve for throttling in said power fluid flow path in order to maintain the velocity of said piston means below a predetermined rate and thereby prevent operation induced excessive shock stresses in said oil well pump which could be damaging to the structure thereof.

2. A pump control means for a hydraulically powered downhole oil well pump having upper and lower piston means connected by a pump rod, a well fluid inlet, a power fluid inlet and a pumped fluid outlet, said pump control means comprising:

a valve means including a tubular valve housing with a tubular valve sleeve longitudinally movably mounted therein to receive power fluid and to move in order to establish alternate fluid flow paths to alternately direct power fluid to said upper and lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by recess portions of said tubular valve sleeve and fluid passages in said tubular valve housing to regulate fluid flow in the flow path of the power fluid for regulating the velocity of said piston means; and (c) means to control said power fluid throttling means having means to sense pressures that cause said piston means to move and accordingly in response to these pressures so position said tubular valve sleeve for throttling in said power fluid flow path in order to maintain the velocity of said piston means below a predetermined rate and thereby prevent operation induced excessive shock stresses in said oil well pump which could be damaging to the sturcture thereof, said power fluid throttling means having an annular recess around and within a mid-portion of said tubular valve housing and in fluid communication with said power fluid inlet, and said tubular valve housing having a pair of fluid outlet annular recesses around and within opposed end portions thereof which are in fluid communication with said upper piston means and said lower piston means; and said tubular valve sleeve having a pair of recesses on generally opposite sides of the mid-portion thereof and said tubular valve sleeve having a pair of recesses in fluid communication with each other on generally opposite sides of each end portion thereof for providing fluid communication between said pumped fluid outlet and said fluid outlet and said fluid outlet annular recesses wherein said tubular valve sleeve recesses overlap said tubular valve housing annular recesses in order to complete fluid communication and form fluid flow restrictive orifices for throttling fluid flow into and from both of said piston means during operation of said pump.

3. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a valve chamber therein and a tubular valve sleeve longitudinally movably mounted in the valve chamber therein to receive power fluid and to move within said tubular valve housing in order to establish alternate fluid flow paths to alternately direct power fluid to said upper and said lower piston means in conjunction with simultaneously directing spent power fluid from said upper and lower piston means to said outlet and directing pumped well fluid to said outlet in order to cause reciprocating motion of said piston means and pumping of well fluid, (b) power fluid throttling means having fluid flow restricting passage segments formed by recess portions of said tubular valve sleeve and fluid passages in said tubular valve housing to restrict fluid flow in the flow path of the power fluid for regulating the velocity of said piston means, (c) said valve means additionally including a means to displace said tubular valve sleeve including separate passages within said tubular valve sleeve communicating from outlets at opposed ends thereof to inlets in a midportion of the bore thereof; a pair of longitudinally spaced annular recesses around opposed end portions of said pump rod; and a pair of passages transversely through said tubular valve sleeve from the exterior thereof to the bore thereof, with said tubular valve sleeve positioned at one end of said valve chamber, said pump rod moves in the direction of that end and fluid pressure is communicated to the opposite end of said tubular valve housing through the internal passage connecting to said opposite end, said pump rod being arranged such that upon reaching the end portion of the stroke said annular recesses are positioned within said tubular valve sleeve to direct fluid from the end having fluid pressure applied thereto to said outlet and to direct power fluid from one of said transverse passages to the tubular valve sleeve internal passage communicating with the opposite end of the tubular valve sleeve for applying power fluid pressure for displacing said tubular valve sleeve to the opposite end of the valve chamber and thus redirecting fluid flow within the tubular valve housing for reversing the direction of motion of said piston means.

4. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and said lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means to regulate fluid flow in the flow path of the power fluid for regulating the velocity of said piston means;

(c) said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet annular recesses wherein said tubular valve sleeve recesses overlap said tubular valve housing annular recesses in order to complete fluid communication and thereby form fluid flow restrictive orifices for throttling fluid flow into and from both of said piston means;

(d) means to control said power fluid throttling means having means to sense pressures that includes a pair of separate longitudinal passages within said tubular valve sleeve communicating from opposite ends thereof to separate pressure sensing ports opening to the exterior of said tubular valve sleeve at the mid-portion thereof, wherein:

(1) one of said longitudinal passages communicates fluid pressure to one end of the tubular valve sleeve from the power fluid applied to one of said piston means via one pressure sensing port as said tubular valve sleeve moves toward a position wherein said pump operates in the throttle mode, and a second pressure sensing port when said pump is in said throttle mode and also combined with fluid pressure from the fluid outlet via another of said pressure sensing ports; and (2) the other of said longitudinal passages communicates fluid pressure to the other end of said tubular valve sleeve from the spent power fluid leaving the opposite piston means to communicate such pressures to pressure effective portions of said tubular valve sleeve in order to displace said tubular valve sleeve as necessary and in response to such sensed pressure for operating said power fluid throttle means to regulate the velocity of said piston means.

5. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and said lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means to regulate fluid flow in the flow path of the power fluid for regulating the velocity of said piston means;

(c) said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet annular recesses wherein said tubular valve sleeve recesses overlap said tubular valve housing annular recesses in order to complete fluid communication and thereby form fluid flow restrictive orifices for throttling fluid flow into and from both of said piston means; and (d) means to control said power fluid throttling means having means to sense pressures that includes a pair fo separate longitudinal passages within said tubular valve sleeve communicating from opposite ends thereof to separate pressure sensing ports opening to the exterior of said tubular valve sleeve at the mid-portion thereof wherein;

(e) one of said longitudinal passages communicates fluid pressure to one end of the tubular valve sleeve from the power fluid applied to one of said piston means via one pressure sensing port as said tubular valve sleeve moves toward a position wherein said pump operates in the throttle mode, and a second pressure sensing port when said pump is in said throttle mode;

(f) the other of said longitudinal passages communicates fluid pressure to the other end of said tubular valve sleeve from the power fluid leaving the opposite pistion means in order to balance pressure forces acting on said tubular valve sleeve in accordance with pressures acting on said piston means to communicate such pressures to pressure effective portions of said tubular valve sleeve in order to displace said tubular valve sleeve as necessary and in response to such sensed pressure for operating said power fluid throttle means to regulate the velocity of said piston means.

6. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and said lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means to regulate fluid flow in the flow path of the power fluid for regulating the velocity of said piston means;

(c) said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet annular recesses wherein said tubular valve sleeve recesses overlap said tubular valve housing annular recesses in order to complete fluid communication and thereby form fluid flow restrictive orifices for throttling fluid flow into and from both of said piston means;

(d) means to control said power fluid throttling means having means to sense pressures that includes a pair of separate longitudinal passages within said tubular valve sleeve communicating from opposite ends thereof to separate pressure sensing ports opening to the exterior of said tubular valve sleeve at the mid-portion thereof wherein;

(e) one of said longitudinal passages communicates fluid pressure to one end of the tubular valve sleeve from the power fluid applied to one of said piston means via one pressure sensing port as said tubular valve sleeve moves toward a position wherein said pump can operate in the throttle mode, and a second pressure sensing port when said pump is in said throttle mode and also combined with fluid pressure from the fluid outlet via another of said pressure sensing ports; and (f) the other of said longitudinal passages communicates fluid pressure to the other end of said tubular valve sleeve from the spent power fluid leaving the opposite piston means, and also pressure from the power fluid to the first named piston means in order to balance pressure forces acting on said tubular valve sleeve in accordance with pressures acting on said piston means to communicate such pressures to pressure effective portions of said tubular valve sleeve in order to displace said tubular valve sleeve as necessary and in response to such sensed pressure for operating said power fluid throttle means to regulate the velocity of said piston means.

7. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and said lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means to regulate fluid flow in the flow path of the power fluid for regulating the velocity of said piston means;

(c) said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet annular recesses wherein said tubular valve sleeve recesses overlap said tubular valve housing annular recesses in order to complete fluid communication and thereby form fluid flow restrictive orifices for throttling fluid flow into and from both of said piston means;

(d) means to control said power fluid throttling means having means to sense pressures that includes a pair of separate longitudinal passages within said tubular valve sleeve communicating from opposite ends thereof to separate pressure sensing ports opening to the exterior of said tubular valve sleeve at the mid-portion thereof wherein;

(e) one of said longitudinal passages communicates fluid pressure to one end of the tubular valve sleeve from the power fluid applied to one of said piston means via one pressure sensing port and also combined with fluid pressure from the fluid outlet via another of said pressure sensing ports; and (f) the other of said longitudinal passages communicates fluid pressure to the other end of said tubular valve sleeve from the spent power fluid leaving the opposite piston means to communicate such pressures to pressure effective portions of said tubular valve sleeve in order to displace said tubular valve sleeve as necessary and in response to such sensed pressure for operating said power fluid throttle means to regulate the velocity of said piston means.

8. A pump control means for a hydraulically powered downhole oil well pump having upper and lower piston means connected by a pump rod, a well fluid inlet, a power fluid inlet and a pumped fluid outlet, said pump control means comprising:

(a) a valve means to receive power fluid and to alternately direct it to said upper and said lower piston means in conjunction with alternately directing spent power fluid from said upper and lower piston means to said outlet and directing pumped well fluid to said outlet in order to cause reciprocating motion of said piston means and pumping of well fluid;

(b) power fluid throttling means having means with said valve means to regulate fluid flow in the flow path of the power fluid in order to operably regulate the velocity of said piston means; and (c) means to control said power fluid throttling means having pressure-sensing means connected to both said upper and lower piston means simultaneously to sense the pressures of said power fluid and said spent power fluid as applied to said upper and lower piston means for both directions of travel of said piston means and to accordingly actuate said power fluid throttling means to in turn control the velocity of said piston means and thereby preventing operation induced excessive shock stresses in said oil well pump which could be damaging to the structure thereof.

9. The pump control means of claim 8, wherein said power fluid throttling means has a variable orifice formed between a valve member and an outlet port of a surrounding valve housing in order to throttle fluid flow in said power fluid flow path.

10. The pump control means of claim 8, wherein:

(a) said pressure-sensing means has a pair of pressure sensing ports and a connected passage in said valve means, one of said ports and associated passages being arranged to sense a pressure acting on said pump and urging said piston means in one direction and the other simultaneously sensing fluid pressure resisting movement of said piston assembly; and (b) said pressure-sensing means has said passages thereof arranged to operably apply simultaneously both of the sensed pressures to said valve means in order to affect the displacement thereof.

11. In a fluid operated well pump having:

an elongated body containing a piston means including an upper pump cylinder having an upper pump piston movably mounted therein and a lower pump cylinder having a lower pump piston movably mounted therein and having said pistons connected by a piston rod extending through a mid-portion of said body;

a well fluid inlet passage means communicatively connected to a source of well fluid;

a pumped well fluid discharge passage means connecting to a well outlet conduit;

a power fluid inlet passage means connectable to a source of power fluid at a relatively high pressure;

an exhausted power fluid outlet passage means connectable to said well outlet conduit;

valve means in said fluid operated pump arranged for being positioned to establish fluid communication flow paths with said well fluid inlet passage, said pumped well fluid discharge passage, said power fluid inlet passage and said exhausted power fluid outlet passage in order to alternately direct fluid to and from each of said piston cylinders;

a method of controlling the well pump, comprising the steps of:

(a) positioning the valve means to simultaneously direct power fluid to act on a piston in one of said pump cylinders, discharge pumped well fluid from that pump cylinder, and draw well fluid into and discharge spent power fluid from the other pump cylinder in order to cause displacement of said pistons;

(b) sensing the difference in the pressures of said power and said spent power fluids acting on said pistons for both directions of travel thereof;

(c) throttling the flow of fluid in the flow paths established by said valve means during motion of said pistons in response to said sensed pressure differences such that the velocity of said pistons is kept below a predetermined velocity; and (d) reversing the direction of motion of said pistons upon their reaching the end of one stroke by repositioning said valve means such that it establishes flow paths for directing the fluids in a manner similar to the preceding stroke with respect to the opposite pistons and associated pump cylinders.

12. The method of claim 11, wherein:

said reversing the direction of motion of said pistons includes applying power fluid to one end of a valve member of said valve means thereby displacing it to the opposite end of a valve chamber in which the valve member is mounted in order to rearrange the fluid communication flow paths to reverse the direction of motion of the piston means.

13. The method of claim 11, wherein:

(a) said throttling includes varying port openings between said valve means and flow paths communicating power fluid to the piston means and exhausted power fluid from the piston means; and (b) said throttling occurs during operation of the pump except when the pump is fully loaded with liquid and no cavitation occurs.

14. The method of claim 13, wherein:

said throttling includes varying the position of said valve means in response to resisitive pressure of pumped fluid acting on said pistons, resistive pressure of power fluid applied to said pistons, and pressure of well fluid acting on said pistons.

15. The method of claim 13, wherein:

said reversing the direction of motion of said pistons includes applying power fluid to one end of a valve member of said valve means thereby displacing it to the opposite end of a valve chamber in which the valve member is mounted in order to rearrange the fluid communication flow paths to reverse the direction of motion of the piston means.

16. A pump control means for a hydraulically powered downhole oil well pump having upper and lower piston means connected by a pump rod, a well fluid inlet, a power fluid inlet and a pumped fluid outlet, said pump control means comprising:

(a) a valve means including a tubular valve housing with a tubular valve sleeve longitudinally movably mounted therein to receive power fluid and to move in order to establish alternate fluid flow paths to alternately direct power fluid to said upper and lower piston means in conjunction with simultaneously directing spent power fluid from said upper and lower piston means to said outlet and directing pumped well fluid to said outlet in order to cause reciprocating motion of said piston means and pumping of well fluid;

(b) power fluid throttling means having variable dimension fluid flow restricting passage segments formed by recess portions of said tubular valve sleeve and fluid passages in said tubular valve housing to regulate fluid flow in the flow path of the power fluid for regulating the velocity of said piston means; and (c) means to control said power fluid throttling means having means to sense pressures that cause said piston means to move and accordingly in response to these pressures so position said tubular valve sleeve for throttling in said power fluid flow path in order to maintain the velocity of said piston means below a predetermined rate and thereby prevent operation induced excessive shock stresses in said oil well pump which could be damaging to the structure thereof, said means to sense pressure including a pair of separate longitudinal passages within said tubular valve sleeve communicating from opposite ends thereof to separate pressure sensing ports opening to the exterior of said tubular valve sleeve at the mid-portion thereof, said pressure sensing ports being arranged to sense fluid pressure acting on said pump which affects displacement of said piston means and to communicate such pressures to pressure effective portions of said tubular valve sleeve in order to displace said tubular valve sleeve as necessary and in response to such sensed pressure for operating said power fluid throttle means to regulate the velocity of said piston means.

17. The pump control means of claim 16, wherein said power fluid throttling means has an annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means; and said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet and said fluid outlet annular recesses wherein said tubular valve sleeve recesses overlap said tubular valve housing annular recesses in order to complete fluid communication to form fluid flow restrictive orifices for throttling fluid flow into and from both of said piston means during operation of said pump; said means to sense pressure has three of said pressure sensing ports communicating to each of said longitudinal passages; and wherein said tubular valve sleeve is positioned such that during operation of said pump in a throttle mode:

(a) one of said longitudinal passages communicates fluid pressure to one end of the tubular valve sleeve from the power fluid applied to one of said piston means via one pressure sensing port as said tubular valve sleeve moves toward a position wherein said pump operates in the throttle mode, and a second pressure sensing port when said pump is in said throttle mode and also combined with fluid pressure from the fluid outlet via another of said pressure sensing ports, and (b) the other of said longitudinal passages communicates fluid pressure to the other end of said tubular valve sleeve from the spent power fluid leaving the opposite piston means, said pump continues operation in said throttling mode until pressure of said fluid outlet substantially reasches the pressure of said power fluid whereupon pressure equivalent to the power fluid pressure is applied to one end of said tubular valve sleeve and a lesser pressure equivalent to pressure of the spent power fluid is applied to the opposite end thereof and said tubular valve sleeve is displaced to an end of its mounting enclosure in said tubular valve housing and motion of said piston means continues without regulation of the velocity thereof.

18. The pump control means of claim 16, wherein said power fluid throttling means has an annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means; said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet and said fluid outlet annular recesses wherein said tubular valve sleeve recesses overlap said tubular valve housing annular recesses in order to complete fluid communication and form fluid flow restrictive orifices for throttling fluid flow into and from both of said piston means during operation of said pump; said means to sense pressure has three of said pressure sensing ports communicating to each of said longitudinal passages; and wherein said tubular valve sleeve is positioned such that during operation of said pump in a throttle mode;

(a) one of said longitudinal passages communicates fluid pressure to one end of the tubular valve sleeve from the power fluid applied to one of said piston means via one pressure sensing port as said tubular valve sleeve moves toward a position wherein said pump operates in the throttle mode, and a second pressure sensing port when said pump is in said throttle mode and (b) the other of said longitudinal passages communicates fluid pressure to the other end of said tubular valve sleeve from the spent power fluid leaving the opposite piston means, in order to balance pressure forces acting on said tubular valve sleeve in accordance with pressures acting on said piston means, said pump continues operation in said throttling mode until pressure of said fluid outlet substantially reaches the pressure of said power fluid whereupon pressure equivalent to the power fluid is applied to one end of said tubular valve sleeve and a lesser pressure equivalent to the spent power fluid is applied to the opposite end thereof and said tubular valve sleeve is displaced to an end of its mounting enclosure in said tubular valve housing and motion of said piston means continues without regulation of the velocity thereof.

19. The pump control means of claim 16, wherein said power fluid throttling means has an annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means; said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet and said fluid outlet annular recesses wherein said tubular valve sleeve recesses overlap said tubular valve housing annular recesses in order to complete fluid communication and form fluid flow restrictive orifices for throttling fluid flow into and from both of said piston means during operation of said pump; said means to sense pressure has three of said pressure sensing ports communicating to each of said longitudinal passages and wherein said tubular valve sleeve is positioned such that during operation of said pump:

(a) one of said longitudinal passages communicates fluid pressure to one end of the tubular valve sleeve from the power fluid applied to one of said piston means via one pressure sensing port as said tubular valve sleeve moves toward a position wherein said pump can operate in the throttle mode, and a second pressure sensing port when said pump is in said throttle mode and also combined with fluid pressure from the fluid outlet via another of said pressure sensing ports, and (b) the other of said longitudinal passages communicates fluid pressure to the other end of said tubular valve sleeve from the spent power fluid leaving the opposite piston means, in order to balance pressure forces acting on said tubular valve sleeve in accordance with pressures acting on said piston means, said pump operates in said throttling mode until pressure of said fluid outlet substantially reaches the pressure of said power fluid whereupon such changes in pressure cause pressure equivalent to the power fluid pressure to be applied to one end of said tubular valve sleeve and a lesser pressure equivalent to the spent power fluid to be applied to the opposite end thereof and said tubular valve sleeve to therefore be displaced to an end of its mounting enclosure in said tubular valve housing whereupon motion of said piston means continues without regulation of the velocity thereof.

20. The pump control means of claim 16, wherein said power fluid throttling means has an annular recess around and within a mid-portion of said tubular valve housing and in fluid communication with said power fluid inlet, and said tubular valve housing has a pair of fluid outlet annular recesses around and within opposed end portions thereof which are in fluid communication with said upper piston means and said lower piston means; said tubular valve sleeve has a pair of recesses on generally opposite sides of the mid-portion thereof and said tubular valve sleeve has a pair of recesses in fluid communication with each other on generally opposite sides of each end portion thereof for providing fluid communication between said pumped fluid outlet and said fluid outlet and said fluid outlet annular recesses wherein said tubular valve sleeve recesses overlap said tubular valve housing annular recesses in order to complete fluid communication and form fluid flow restrictive orifices for throttling fluid flow into and from both of said piston means during operation of said pump; said means to sense pressure has two of said pressure sensing ports communicating to each of said longitudinal passages and wherein said tubular valve sleeve is positioned such that during operation of said pump in a throttle mode:

(a) one of said longitudinal passages communicates fluid pressure to one end of the tubular valve sleeve from the power fluid applied to one of said piston means via one pressure sensing port and also combined with fluid pressure from the fluid outlet via another of said pressure sensing ports, and (b) the other of said longitudinal passages communicates fluid pressure to the other end of said tubular valve sleeve from the spent power fluid leaving the opposite piston means, said pump operates in said throttling mode until pressure of said fluid outlet substantially reaches the pressure of said power fluid whereupon such changes in pressure cause pressure equivalent to the power fluid pressure to be applied to one end of said tubular valve sleeve and a lesser pressure equivalent to the spent power fluid to be applied to the opposite end thereof and said tubular valve sleeve to therefore be displaced to an end of its mounting enclosure in said tubular valve housing whereupon motion of said piston means continues without regulation of the velocity thereof.

21. In a fluid operated well pump having:

an elongated body containing a piston means including an upper pumping cylinder having an upper pump piston movably mounted therein and a lower pumping cylinder having a lower pump piston movably mounted therein and having said pistons connected by a piston rod extending through a midportion of said body;

a well fluid inlet passage means communicatively connectable to a source of well fluid;

a pumped well fluid discharge passage means connectable to a well outlet conduit;

a power fluid inlet passage means connectable to a source of power fluid at a relatively high pressure;

an exhausted power fluid outlet passage means connectable to said well outlet conduit;

valve means in said fluid operated pump including a tubular valve sleeve slidably mounted around said piston rod and longitudinally slidably mounted within an elongated valve chamber in said body and longitudinally movable within said elongated valve chamber in response to fluid pressure applied thereto;

a method of controlling said well pump comprising the steps of:

(a) by positioning said valve means such that said power fluid is applied to cause a resulting upward movement of said piston assembly by fluidically connecting said lower cylinder above said lower piston to said exhausted power fluid outlet passage means and said upper cylinder below said upper piston to said power fluid inlet passage means;

(b) fluidically connecting said power fluid inlet passage means to the upper end of said tubular valve sleeve and fluidically connecting said exhausted power fluid outlet passage to the lower end of said tubular valve sleeve during upward movement of said piston assembly at the uppermost portion of the stroke thereof before reversal in order to cause a downward displacement of said tubular valve sleeve;

(c) throttling the flow of said power fluid to said piston means and exhausted power fluid from said piston means in order to maintain the velocity of said piston means at or below a predetermined value;

(d) terminating said fluidic connection of said power fluid inlet passage means to said upper cylinder below said upper piston, termination of said fluidic connection of said exhausted power fluid outlet passage means to said lower cylinder above said lower piston, and termination of said upward movement of said piston assembly;

(e) fluidically connecting said upper cylinder below said upper piston to said exhausted power fluid outlet passage means and said lower cylinder above said lower piston to said power fluid inlet passage means after termination of said upward movement of said piston assembly and during downward movement thereof;

(f) fluidically connecting said power fluid inlet passage means to said lower end of said generally tubular valve sleeve and connecting said exhausted power fluid outlet passage means to said upper end of said generally tubular valve sleeve in order to cause an upward displacement of said tubular valve sleeve during downward movement of said piston assembly in the lowermost portion of the stroke thereof before reversal;

(g) throttling the flow of said power fluid to said piston means and exhausted power fluid from said piston means in order to maintain the velocity of said piston means at or below a predetermined value;

(h) terminating said fluidic connection of said power fluid inlet passage means said lower cylinder above said lower piston, terminating of said fluidic connection of said exhausted power fluid outlet passage means to said upper cylinder below said upper piston, and terminating of said downward movement of said piston assembly during upward movement of said tubular valve sleeve; and (i) after said termination of said downward movement of said piston assembly and during said upward movement of said tubular valve sleeve, again connecting said lower cylinder above said lower piston to said exhausted power fluid outlet passage means and said upper cylinder below said upper piston to said power fluid inlet passage means in order to permit upward movement of said piston assembly.

22. The method of claim 21, wherein:

said throttling occurs during operation of the pump except when the pump is fully loaded with liquid and no cavitation occurs.

23. The method of claim 21, wherein:

said reversing the direction of motion of said pistons includes applying power fluid to one end of a valve member of said valve means thereby displacing it to the opposite end of a valve chamber in which the valve member is mounted in order to rearrange the fluid communication flow paths to reverse the direction of motion of the piston means.

24. The method of claim 21, wherein:

said throttling includes varying port openings between said valve means and flow paths communicating power fluid to the piston means and exhausted power fluid from the piston means.

25. The method of claim 24, wherein:

said throttling includes varying the position of said valve means in response to resistive pressure of pumped fluid acting on said pistons, resistive pressure of power fluid applied to said pistons, and pressure of well fluid acting on said pistons.

26. The method of claim 24, wherein:

said reversing the direction of motion of said pistons includes applying power fluid to one end of a valve member of said valve means thereby displacing it to the opposite end of a valve chamber in which the valve member is mounted in order to rearrange the fluid communication flow paths to reverse the direction of motion of the piston means.

* * * * *